US006981895B2

(12) United States Patent
Potega

(10) Patent No.: US 6,981,895 B2
(45) Date of Patent: Jan. 3, 2006

(54) INTERFACE APPARATUS FOR SELECTIVELY CONNECTING ELECTRICAL DEVICES

(76) Inventor: Patrick Potega, 7021 Vicky Ave., West Hills, CA (US) 91307-2314

( * ) Notice: Subject to any disclaimer, the term of this patent is extended or adjusted under 35 U.S.C. 154(b) by 2 days.

(21) Appl. No.: 10/402,709

(22) Filed: Mar. 29, 2003

(65) Prior Publication Data

US 2004/0009702 A1 Jan. 15, 2004

Related U.S. Application Data

(62) Division of application No. 09/378,781, filed on Aug. 23, 1999, now Pat. No. 6,634,896.

(51) Int. Cl.
*H01R 9/05* (2006.01)

(52) U.S. Cl. ..... 439/578; 439/669; 439/218

(58) Field of Classification Search ..... 439/218, 439/221–224, 668–669
See application file for complete search history.

(56) References Cited

U.S. PATENT DOCUMENTS 4,420,216 A * 12/1983 Motoyama et al. ..... 439/188
5,137,469 A * 8/1992 Carpenter et al. ..... 439/578
5,569,053 A * 10/1996 Nelson et al. ..... 439/668
5,823,796 A * 10/1998 Bethurum ..... 439/76.1
5,915,995 A * 6/1999 Meyer et al. ..... 439/668
6,044,472 A * 3/2000 Crohas ..... 713/300
6,109,797 A * 8/2000 Nagura et al. ..... 385/88
6,149,469 A * 11/2000 Kim ..... 439/668
6,459,175 B1 * 10/2002 Potega ..... 307/149

* cited by examiner

*Primary Examiner*—Hae Moon Hyeon

(57) ABSTRACT

An interface apparatus for power and/or data connections, comprised of a connector assembly (101F in FIGS. 1A and 1B) which has a configurable plug (101A) with conductors (123A and B, and 125A and B), and a barrel-style assembly (103) that engages a receptacle (101B) having conductors (157, 159, 161, and 163), and related elements (127, 130, 133A, and 133B in FIG. 3) that redirect electrical signals upon insertion of the plug. Redirecting electrical signals enables host devices, power sources, and peripherals—such as a host device (168 in FIG. 1B), its battery source (166), as well as one or more attachable peripherals (150, 152, 154, 156, 158, 160, 162 and 164 in FIG. 1A)—to transfer signals in ways they could not without such an apparatus. By locating a receptacle (101B in FIG. 1B) in replaceable modules, such as battery packs (166), users can upgrade and enhance the functionality of a multiplicity of existing (and future) electronic and electrical goods.

2 Claims, 8 Drawing Sheets

101A
105
107
109
111
145
125A
125B
123B
123A
103
113
115

Peripheral(s) 150
Power Supply 152
Monitoring Device 154
Battery Charger 156
A/D Converter 158
Processor 160
Program Instructions 162
Battery 164
101B
149
101F
165
147
151
155
153
157
159
174
172
170
168
166
A/D Converter
Processor
Program Instructions
Battery
Host
161
163

INTERFACE APPARATUS FOR SELECTIVELY CONNECTING ELECTRICAL DEVICES

CROSS-REFERENCE TO RELATED APPLICATIONS

This application is a division of "Method and Apparatus for Transferring Electrical Signals Among Electrical Devices," now U.S. Pat. No. 6,634,896, issued 21 October 2003, previously filed as U.S. patent application Ser. No. 09/378,781, dated 23 Aug. 1999 as a CIP of "Apparatus for Monitoring Temperature of a Power Source," filed previously as U.S. patent application Ser. No. 09/105,489, dated 26 Jun. 1998, and subsequently as U.S. Pat. No. 6,152,597 issued 28 Nov. 2000; and claims the benefit of previously filed U.S. Provisional Patent Application No. 60/051,035, dated 27 Jun. 1997, and "A Resistive Ink-Based Thermistor," U.S. Provisional Patent Application No. 60/055,883, dated 15 Aug. 1997, as well as International Patent Application No. PCT/US98/12807, dated 26 Jun. 1998; and further claims the benefit of "Apparatus for a Power and/or Data I/O," U.S. Provisional Patent Application No. 60/097,748, filed 24 Aug. 1998; "Hardware to Configure Battery and Power Delivery Software," U.S. Provisional Patent Application No. 60/114,412, dated 31 Dec. 1998, and subsequently U.S. patent application Ser. No. 09/475,946, "Hardware for Configuring and Delivering Power," dated 31 Dec. 1999; "Software to Configure Battery and Power Delivery Hardware," U.S. Provisional Patent Application No. 60/114,398, dated 31 Dec. 1998, and subsequently U.S. patent application Ser. No. 09/475,945, "Software for Configuring and Delivering Power," dated 31 Dec. 1999; and "Universal Power Supply," now U.S. Pat. No. 6,459,175, issued 1 Oct. 2002, previously filed as U.S. patent application Ser. No. 09/193,790, dated 17 Nov. 1998 (also as International Patent Application No. PCT/US98/24403, dated 17 Nov. 1998), filed previously as U.S. Provisional Patent Application No. 60/065,773, dated 17 Nov. 1997.

FIELD OF INVENTION

The invention relates to connector-interface assemblies, specifically to a connector apparatus that is configurable to selectively inter-connect power sources, powered devices, and a multiplicity of attachable peripherals.

BACKGROUND OF THE INVENTION

Devices that have removable battery packs, such as laptop computers, personal audio and video players, etc., most often have two power input jacks. The first power-input port is obvious . . . it is where the connector from the external wall adapter, AC/DC power-conversion adapter, DC/DC automotive cigarette-lighter adapter, external battery charger, etc., is plugged in.

The second power-input port is not so obvious . . . it is where a removable battery pack connects to its associated host device. Usually, this is a power (or mixed-signal power and data) connector hidden in a battery bay, or expressed as a cord and connector inside a battery compartment, such as is found in some cordless phones. The connector between a battery pack and its associated host device may simply be a group of spring contacts and a mating set of contact pads. This second power port is not used for external power (a host's removable battery power source is usually not classified as "external" power). The battery power port is so unrecognized that even supplemental external "extended run-time" battery packs, as are available from companies like Portable Energy Products, Inc. (Scotts Valley, Calif.), connect to the same traditional power jack to which the external power supply does.

The connector assembly herein exploits this un-utilized battery-to-host interface in a number of ways. As will be seen, a battery pack's power port is, in many ways, a far more logical power interface than the traditional power-input jack. By using a flexible and scaleable connector that is small enough to be enclosed within a battery pack housing, and providing sufficient connector contacts to handle power, the usefulness of external power devices and the battery pack itself can be enhanced.

Also, "smart" battery packs support connectors that are mixed signal, i.e., both power and data, therefore external power devices can data communicate with host devices and smart batteries, often facilitating device configuration, operation and power monitoring.

Some of the reasons why the battery-contact interface isn't used are that it's often inaccessible. In laptop computers, for example, the battery-to-host-device connector is often buried deep in a battery bay. The connector assembly described in this document is built into the battery pack itself, at a location where easy access to a connector is available. Where appropriate, conductors from a non-removable battery are routed to an accessible location on the host device. Even when the location of the connector assembly is remote from the battery pack, the interface addressed is that between the battery pack and its associated connector on the host device.

Another reason for the lack of attention to the battery's power connector is that the type of connector used between a battery and its host device is not usually of the design and style that would easily lend itself to being attached to the end of a power cord. A good example of how awkward such battery access connectors can be is the "empty" battery housing with power cord that is popular with camcorders. The camcorder's "faux" battery pack shell snaps into the normal battery pack mount, and there is usually a hardwired cord to a power-conversion adapter. This makes for a considerable amount of bulky goods to transport. That is the case with cellular phones, as well, with "empty" battery housings that plug into an automotive cigarette lighter, or a battery pack with an integrated charger. These are often bulkier than the battery pack they replace and, almost always, one must have a unique assembly—complete with cords—dedicated to a specific make or model of cellular phone.

The connector assemblies shown in the various figures, and described herein, are designed to be of the look and style normally associated with power and or data cords. Barrel-style connectors, and segmented-pin-types are common connector styles. By defining new barrel connectors that feature segmented contacts, or using segmented pin connectors in wiring schemes that create new connectivity paths, hitherto unknown ways of dealing with safety through power subsystem configurations are achieved. No bulky external add-ons are used. Instead, miniaturized connectors that can be embedded within an existing battery pack define new ways of powering battery-powered devices.

The battery packs discussed here are not empty battery enclosures, with only passthrough wiring. The original battery cells, circuit boards, fuses, etc., are all present and the connectors shown herein provide means to have a battery pack operate normally when the plugs are removed (or replaced).

Battery Pack Removal

Another reason a battery port connector is not used is that to access this unexploited power port would require removing the battery pack, which would result in the loss of available battery power. Some host devices require that a battery pack be present, as the battery may be serial-wired. Also, host devices are known that use the battery pack as a "bridge" battery that keeps CMOS, clocks, etc., functioning. Battery removal could negatively impact such devices. Removing a battery pack also results in even more bulky things to carry around, which hardly fits the travel needs of someone carrying a laptop or other mobile device.

A host device and its associated battery pack present a well-suited environment for a connector assembly that can, by the insertion or removal of its plug element, create or reconfigure circuits.

Battery packs or holders, with either primary cells or rechargeable cell clusters, are typically removable. So, if an interface apparatus is fitted into the confines of an existing battery pack, and the newly-created circuits achieved by doing so can be defined by contacts and conductors integrated into the battery pack itself, then the use of host devices is dramatically enhanced. Reconfiguring the battery pack does not change the existing contacts on the exterior of the battery enclosure, nor the contacts at the device-side of the as-manufactured battery-to-device I/O port. Consumers can simply acquire such an upgraded removable battery pack, and install the reconfigured one. Manufacturers of host devices will be able to offer an accessory product that enhances the usefulness and functionality of their host devices, without having to modify existing host devices already in consumers' hands.

Because batteries do wear out, consumers will—sooner or later—require a replacement battery pack. For example, today's Lithium-Ion battery cells claim about 500 charge/discharge cycles. In reality, the average battery user can expect only about 300. That usually equates to the battery's storage capacity starting to show signs of decreased run time in approximately 1–1.5 years. The user's awareness of decreased capacity may happen even sooner, especially with cellular phone battery packs. Reduced talk time or wait time is often noticed quickly by a cellular phone user. But, whatever the application, battery-powered device users inevitably are required to replace a worn-out battery.

By embedding connectors in the battery pack, no circuits are created within the host devices. This is useful because battery packs are virtually always removable and replaceable. Instead of having to pre-plan and design-in new power and data paths into a host device, the replaceable battery pack contains these power and data paths. Simply replacing a battery pack upgrades any host device. By placing the technology in a fully-functional battery pack, it is not necessary to remove the battery pack during connector operations . . . instead, keeping the battery pack in its host device, where it belongs, is essential.

Devices that use external power-conversion adapters invariably are designed to always charge the device's removable battery pack every time the external adapter is used. It seems logical that keeping the battery capacity at 100% is a sound practice. However, certain rechargeable battery chemistries don't offer the charge/recharge cycle life that was available with "older" battery technologies. Lithium-Ion (Li-Ion) batteries, for example, can last for only 300 cycles, and sometimes even less than that. In average use, an Li-Ion battery can have a useful life (full run-time, as a function of capacity) of less than a year, and nine months isn't uncommon. Constantly "topping-off" a Lithium-Ion battery only degrades useful battery life.

Being able to elect when to charge the battery, independent of powering the host device, would prolong the life of expensive batteries. By delivering power from external power adapters and chargers through connectors at a newly-defined battery power port, a user need only perform a simple act, such as rotating a connector to select a battery-charge mode, a host-power only mode, or both.

Battery Charging Risks

Battery charging is a destructive process in other ways than repeated unnecessary battery charging sessions. Low-impedance batteries, such as Lithium-Ion, generate heat during the charging process. This is especially true if a cell-voltage imbalance occurs for, as resistance increases, the entire battery pack can overheat. Lithium-ion cells have a reputation for volatility. For example, an article in the Apr. 2, 1998, edition of The Wall Street Journal reported on the potentials of fire, smoke and possible explosion of Li-Ion batteries on commercial aircraft (Andy Pasztor, "Is Recharging Laptop in Flight a Safety Risk?", The Wall Street Journal, Apr. 2, 1998, pp. B1, B12).

To be able to easily disengage a volatile battery cell cluster from its integrated, hardwired battery charging circuit has obvious safety benefits. Several of the modalities of the connector assemblies discussed herein lend themselves to a simple battery bypass circuit within the battery pack, so that a host device can be powered from an external power source such as an aircraft seat-power system, without charging the battery. This function is achievable by simply replacing an existing battery pack with one that incorporates the connector assembly. This is a cost-effective, simple and convenient solution to an important safety concern. Because the connector assembly is a modification to an existing battery pack, and battery products already have a well-established and wide distribution network, availability of this safety device is widespread. No entirely new devices are required to be designed and fabricated, since the connector assembly is essentially an upgrade modification.

Power-Conversion Adapters

Battery flammability and explosive volatility are related to inappropriate power devices upstream of the battery pack. Connecting a power-conversion adapter that has an output voltage not matched to the input voltage of a host device is an easy mistake to make. Laptop computer input voltages, for example, can range from 7.2VDC, to 24VDC. Within that voltage range are a significant number of AC/DC and DC/DC adapters that are power-connector-fit compatible, but which output incompatible voltages. A count of notebook computer power-conversion adapters available from one mail order company numbered over 250 discrete products (iGo, Reno, Nev., www.iGoCorp.com). The probability of a voltage mismatch indicates a serious concern.

Compared to the multiplicity of vast and diverse input voltages battery-powered host devices require, input voltages at battery power ports are not only limited, but more flexible. Since battery output voltages are a function of an individual cell voltage, multiplied by the number of cells wired in series or parallel, there are a limited number of output voltages for battery packs. For example, Lithium-Ion cylindrical cells are manufactured at only 3.6-volts (some are 4.2-volt cells). Thus, virtually every Li-Ion battery pack made outputs either 10.8, or 14.4 volts (with some relatively rare 12.6-volt cell clusters). If an external power-conversion adapter was designed to provide power to a notebook computer host device through the host device's battery port, it is possible that only two output voltages would be required, since the external adapter would electrically "look" to a host device as a battery pack. This adds value to a connector assembly that can eliminate the problem of there being some 42 different types of existing laptop power connectors.

Furthermore, battery pack output voltages vary as a function of charge state. A fully charged battery rated at 10.8-volts actually outputs voltages in a range from about 10 volts, through 14.0-volts (with transient voltages up to 16 volts), depending on the battery's state of charge or discharge. This same host device may be able to accept input voltages at its usual external power-adapter input port within a narrow voltage range of +/−1-volt. Thus, host devices have a far greater tolerance for potential voltage mismatches at their battery power ports, as compared to at the traditional power jack. By providing a power connector that uses the battery's power port, the number of external power devices is significantly reduced, and the overall risk of damaging a host device by a voltage mismatch is minimized.

The heat dissipation from charging a Lithium-Ion battery pack is compounded by the heat being generated by advanced high-speed CPUs. With computer processors running so hot in portable devices that heat sinks, fans, heat pipes, etc., are required, the additional heat from charging a battery only intensifies the thermal issues.

The connector assembly described herein, by disengaging battery charging, extends the life of a host device's components and circuits that otherwise may be compromised or stressed by extended hours of exposure to heat. This is especially valid for host devices like laptop computers, since a number of these products are not used for travel, but instead spend almost all of their useful lives permanently plugged into the AC wall outlet in a home or office, serving as a desktop substitute. In such device applications, the need to repeatedly charge the laptop's battery has no practicality. By using a connector assembly that can be selectively put into a mode of battery charging only when necessary, the working life expectancy of these host devices can be extended by eliminating unnecessary overheating.

Energy Conservation

There's a less obvious reason to not charge batteries on commercial aircraft. Some commercial passenger aircraft provide power systems with power outlets at the passenger seat. The head-end aircraft power source is a generator, so the total amount of energy to power all of the aircraft's electrical system is limited. The Airbus A319, for example, has only sufficient generator capacity to provide seat power for less than 40 passengers' laptop computers (Airbus Service Information Letter (SIL), dated 8 Jan. 1999). A laptop computer being powered from an external power-conversion adapter uses 2040% of the external power to charge its battery pack, which translates to about 15–30 Watts. Generating sufficient power to charge 200+laptop batteries puts a considerable drain on the aircraft's electrical system.

Disabling battery charging by employing a connector assembly described herein is a cost-effective means of lowering an airline's operating costs, by minimizing the total load schedule of the cabin power grid. The airline saves the cost of the fuel required to operate the generator at a higher power capacity.

Airline operators have policies and in-flight rules that prohibit the types of passenger electronic devices that can legally operate on the plane. The use of RF devices, such as cellular phones, and radio-controlled toys, is banned on every commercial aircraft. Passengers may be confused on aircraft operated by American Airlines, for example, since selected passenger seats have power systems for laptop use. This airline's seat power outlet is a standard automotive cigarette-lighter port. An unsuspecting passenger, mistakenly assuming that the cigarette-lighter port was for cellular phones, could easily plug in and turn on a cell phone.

Because there are a number of modalities to the connector assembly described in this document, airlines can elect to use a specific connector style, shape or wiring scheme that is reserved for passenger seat-power. By limiting the use of a receptacle to battery packs for laptops, and not allowing the connector to be used in cellular phone battery packs, for example, an airline can control the types of passenger devices it allows to be connected to its cabin power system.

Battery-Only-Powered Devices

There is also a variety of battery-powered devices that does not have an external power-supply power input jack. Cordless power tools, flashlights, and other devices meant to run strictly on removable and/or externally rechargeable batteries may not have been manufactured with an alternative means of power. If the battery of a cordless drill goes dead, for example, the only recourse is usually to remove the battery and recharge it in its external charger. This is frustrating to anyone who has had to stop in the middle of a project to wait for a battery to recharge.

By integrating a new connector assembly, such as the ones shown in the figures and text herein, circuits can be created that use a host device's battery-power-port interface as a power connector through which power can be delivered from an external power source. A user can elect, when a power outlet is available, to operate devices such as battery-powered drills, saws, etc., from external power, simply by attaching a compliant external power adapter into the connector interface on an exposed face of the battery pack. With some modalities of the connector assembly that is the invention, an external charger can be connected as well, allowing simultaneous equipment use and battery charging in products that hitherto did not have these capabilities.

Devices with holders for individual battery cells fall into this same category of not having an external power port. If the device does have an external port, it is not wired to provide simultaneous battery charging. Not being able to charge replaceable battery cells in a battery holder that is inside the host device lessens the usefulness of rechargeable alkalines, for example.

It is more convenient to leave individually replaceable battery cells in their battery holder while charging, and a number of the modalities of the connector assembly discussed herein allow for that. The added convenience of being able to operate a host device instead of draining its rechargeable alkalines (these battery types typically can only be recharged 10–20 times, then must be discarded), reduces operating costs. The use of the connector assembly saves time, since the user doesn't have to take the time to remove each individual cell and place it in a special charger.

Operational Advantages

Given the above, a number of operational advantages of the connector assembly of the invention become apparent:

(a). A simple, low-cost connector can be used to electrically separate two devices, or a host device and its power system.

(b). By isolating the battery source, or a peripheral, from the original host device, new circuits are created that allow external power sources or battery chargers to perform more safely because the battery voltage can be verified before that external power is applied to a host device.

(c). Because a plug can function as a rotating selector switch that has more than one position, additional circuits or wiring configurations can be created to perform specialty functions or operations.

(d). As a plug that is removable from its cable so that it is interchangeable, so accommodate a variety of attachable sources, peripherals and devices.

(e). With its very small form factors, a receptacle can be embedded inside a battery pack, to make it a self-contained device that has a special power or data interface to external power or charging devices, or monitoring equipment. This can be accomplished without having to rewire or otherwise modify a host device. By replacing the existing battery pack with one configured with a connector assembly that is the invention, the functionality of both a battery and its host device is enhanced, without permanent reconfigurations to either the battery pack or host device.

(f). The connector assembly can be used as a replacement for an existing input power jack, with minimal modifications or rewiring.

(g). Problems with the existing multiplicity of connectors on electronic devices that allow incompatible external adapter output voltages are eliminated. Instead, the receptacle is simply wired in a different configuration, and a new plug is used to differentiate the two incompatible external adapters. Any fear of possible mismatched voltages between external power adapters and host devices is eliminated.

(h). In certain embodiments of the connector assembly that use a connector that self-closes to reinstate a circuit, the need for an ON/OFF power switch in conjunction with a power input jack is eliminated. A plug is now defined that is configurable to turn the host device on when the plug is inserted into the receptacle.

(i). Certain embodiments of the connector assembly can be equipped with a latching mechanism that secures the plug and receptacle assemblies, an important feature for devices like laptops that are often moved around the local area in industrial or service applications.

(j). In certain environments, host devices that automatically charge their batteries when external power is applied can be easily modified by inserting a battery pack that has been upgraded to the connector assembly in this invention. Thus configured, the host device is rendered safety compliant.

(k). Simultaneous battery monitoring and power delivery from an external device can be done without modifying the internal circuitry of the host device.

(l). By installing a switch that responds to applied power signals, and locating that switch in either the plug or receptacle of the connector assembly, battery monitoring and power delivery can occur with a two-conductor cable that shares more than two contacts in a connector assembly.

(m). Monitoring battery charging can be done by an external device attached to a connector assembly such as those defined herein, which may be capable of power, data, or both.

Applications

An upgraded battery pack that creates different electrical paths for power, data, or both when a plug is inserted or removed may, for example, include applications such as (but not limited to) the following:

1) Diminish the need to be charging a battery pack when an external power source is available. By not charging a battery every time a host device is connected to an external source of power, the life expectancy of the battery is increased. Since most rechargeable battery-powered electronic devices automatically charge their batteries when external power is connected, the use of a connector that disables the battery charge function increases the useful life of the battery, thus reducing total operating cost.

2) Some locations may not find battery charging practical. Battery charging can consume 2040% of the entire load schedule of a host device's power requirements. If a car's battery is low, operating a host device such as a laptop for an extended time from the dashboard outlet could result in a stranded motorist.

3) Some transportation locations may not be suitable for battery charging. There is some risk in charging batteries, especially high-density Lithium-Ion batteries. An airline, or cruise ship operator, for example, may wish to limit the risk of an onboard battery-related fire or explosion. A simple and cost effective method would be to use battery packs and power cords that have a connector which disables the charge function, while still allowing an external power supply to power the host device only.

4) Extended-run-time external battery packs can be used to supplement a host-device's associated battery. These extra-high-capacity battery packs connect to a host device's existing power input jack. So configured, the external battery pack most likely is dedicating some of its stored energy to charging the host device's battery. This occurs because host systems are designed to charge the associated battery whenever external power is available.

As a power source, a host device usually does not distinguish an external battery from an AC/DC wall adapter, for example, so the extended-run-time battery loses its effectiveness by having to relinquish some amount of its stored energy to charging the host's battery. By using a connector as defined herein, the external battery pack can be routed through the host device's existing battery pack and, by doing so, the charging circuits with the host device are temporarily disabled while the external battery source is in use. This enhances the run-time of the external battery pack, and also eliminates inefficient energy transfers between the two batteries.

These non-limiting examples of applications for connector assemblies such as those described in this document show some practical real-world uses.

Design Parameters

Some of the design parameters required to achieve these uses may be:

1) Small package size, especially for the receptacle, since available space within battery packs is limited.
2) Straightforward way to integrate a receptacle into an existing battery pack, or to install the receptacle in a new battery pack design in a way that doesn't require an inordinate amount of extra tooling or assembly.
3) Inexpensive
4) Simplicity of use

SUMMARY OF THE INVENTION

This invention relates to an apparatus for a power and/or data I/O port, specifically connector assemblies which have conductors, insulators and related elements that create different electrical paths than had previously been present in electrical and electronic devices. These newly-created electrical paths enable devices and peripherals to perform power and/or data functions in ways they could not without such an apparatus. By locating a connector assembly of the invention in replaceable modules, such as battery packs, users can upgrade and enhance the functionality of a multiplicity of existing (and future) electronic and electrical goods.

DETAILED DESCRIPTION OF THE INVENTION

Figures 1A, 1B:
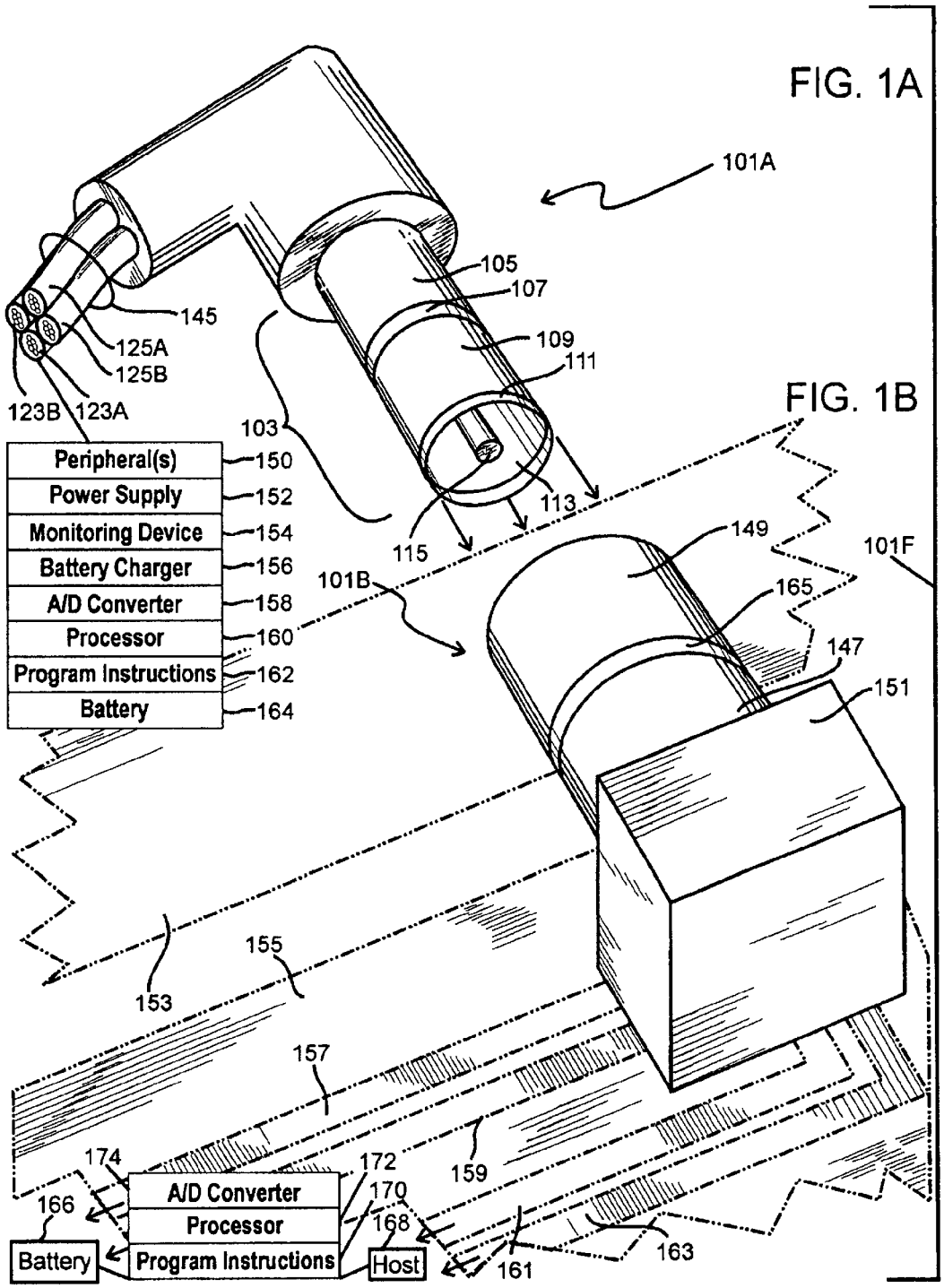
FIGS. 1A and 1B depict a barrel-style connector assembly with configurable segments, that may be mounted internally to a host device, or within a power source such as a battery pack.

The invention provides a method and apparatus for transferring electrical signals including power and input/output information among multiple electrical devices and their components. In the following description, numerous specific details are set forth in order to provide a more thorough understanding of the present invention. It will be apparent, however, to one skilled in the art that the present invention may be practiced without these specific details. However, in order not to unnecessarily obscure the invention, all various implementations or alternate embodiments including well-known features of the invention may have not been described in detail herein.

Theory of Operation

In certain modalities of the invention, the concept of "Dominant Voltage" is applied as a means of delivering power to a battery-powered device. The positionable connector assembly illustrated herein is configurable to simultaneously electrically couple both a battery and an external power source along shared conductors. By such a configuration, the battery is immediately available to the host device should the power supply be turned off or fail. This provides a simple, yet effective, uninterruptable power supply capability.

Incorporating a means of controlling the direction of signal flow allows battery signals to flow to the power supply, but no signal from the power supply can flow to the battery. The power supply is thus able to acquire power and/or data signals from the battery, which are essential to configuring the output of the controllable power supply. The power supply's output is determined by computations that use acquired battery voltage, for example. Thus, if the configurable power supply is acquiring voltage values from a 12-volt battery, the power supply's output will be a value in the 12-volt range.

As discussed, since both the battery and the power supply are connected and accessible to the host device, then a method must be established to make sure that the power supply, and not the battery, is the primary source of power. The concept of Dominant Voltage comes into play when two similar power sources are connected to a load. An example is a 12-volt light bulb to which are attached two 12-volt batteries, each battery being connected to the light bulb by a separate set of conductors. Assuming that the two batteries are not exactly matched in output, e.g., one of the batteries is further discharged than the other, thus the battery that is more deeply discharged outputs a slightly lower voltage than the other. Dominant Voltage would result in the battery with the most charge—higher voltage—delivering power to the light bulb.

This concept is well-recognized in the battery industry, where matching cells (often referred to as "cell balancing") in a battery pack is commonplace with Li-Ion batteries. Even with older battery chemistries, a superior or inferior cell in a pack is recognized as significantly undesirable.

In applying the Dominant Voltage concept to the subject invention, if the means of controlling directional signal flow is a diode, the acquired battery voltage is depressed. Because the anticipated voltage drop of a known diode is available to a processor that has access to the power supply, all computations take into account the voltage drop caused by the diode. The computations are also biased to yield a resulting voltage value that is higher than the acquired battery voltage. This higher voltage ensures that the power supply, instead of the battery, is the primary source of power to the target device.

A bleed resistor across the diode will allow a non-diode-depressed voltage to be available to the external power supply. This eliminates the need to calculate out the error of the diode's voltage drop. This bleed resistor approach can be used in some other diode applications discussed throughout this document.

The connector assembly of the invention accesses the host device at its original battery terminals (typically, these terminals are contacts located in a battery "bay"), and corresponding contacts at the battery housing mate when the battery pack is inserted into the battery bay. By delivering power at this battery-to-host interface, a significant and previously unrecognized advantage is gained. Because battery output voltages fluctuate wildly—from 4+ volts above the cell's rated design voltage, to 3+ volts below that rated voltage—the internal circuitry of the device is designed to operate across a wide range of input voltages. A freshly charged battery label-rated at 12-volts will output 14–16 volts when freshly charged, and a 12-volt battery's design shut-down voltage can be as low as 9 volts. Thus, a properly designed device that uses a 12-volt battery will operate within an input voltage range at its battery I/O from 9 to 16 volts.

On the other hand, that same device's input voltage requirement at its external power port (the "jack" to which AC/DC power adapters attach), typically will have a narrow +/−1-volt input tolerance. Thus, the connector assembly of the invention achieves its maximum potential when interfacing external devices at the battery-to-device circuit, even though the design of the connector embodiments herein are quite well suited as replacements for the traditional power-port "jack." One of the major benefits achieved is that the external power supplies do not have to be built to exacting critical output-voltage tolerances. Lower cost power supplies are the result.

The connector assembly configurations wherein both the external power supply and the battery have access to the host device along shared conductors, the output voltage of the power supply has to be greater than the output voltage of the battery. If not, the battery's higher voltage will be dominant, and the battery will power the host device, instead of power coming from the external power supply. The dominant-voltage effect allows the battery's power signal to immediately become available, should the external power supply ever lose power. Thus, the host device's battery remains a viable alternative source of power, even when the plug is still inserted in its mating receptacle.

In summary, a configuration of three interconnected devices wherein a battery and an attached power supply are both available to deliver power to a host device, the power supply is safely configured at a higher voltage than the battery's typical voltage, which allows the concept of Dominant Voltage to play a significant role in ensuring that the power supply—not the battery—is the primary source of power.

Dominant-Voltage Effect: An Example

The output voltage of an external power supply 152 has to be greater than the output voltage of battery 166 (FIGS. 1A and B). If not, battery 166's higher voltage will be dominant, and the battery will power the host device, instead of power coming from the external power supply 152. The Dominant-Voltage effect allows battery 166's power signal to immediately become available through diode 178 (FIG. 7), should the external power supply ever lose power. Thus, the host device's battery 166 remains a viable alternative source of power, even when plug 101E is still inserted in its mating receptacle 101B.

The power supply, which includes a voltage comparator circuit, configures its output voltage according to one or more acquired power-related parameters. There may be an A/D converter, so that acquired analog information can be output to a controller/processor which configures the power supply's output.

Figure 3:
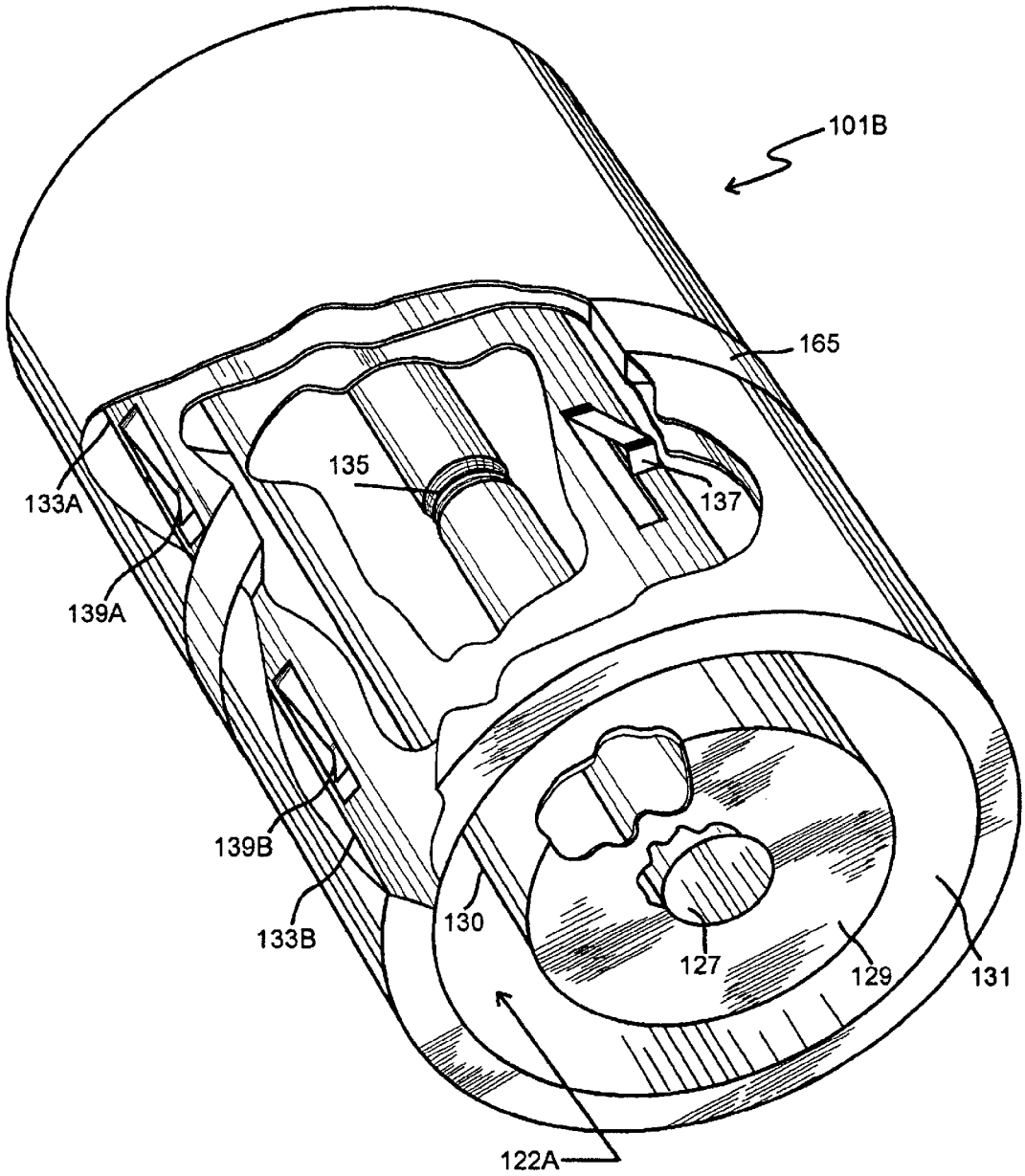
FIG. 3 is an enlarged view of a receptacle of a barrel-style connector assembly, as in FIGS. 1A, 1B, and 2, showing various electrical contacts and the arrangement of elements.
Figure 6:
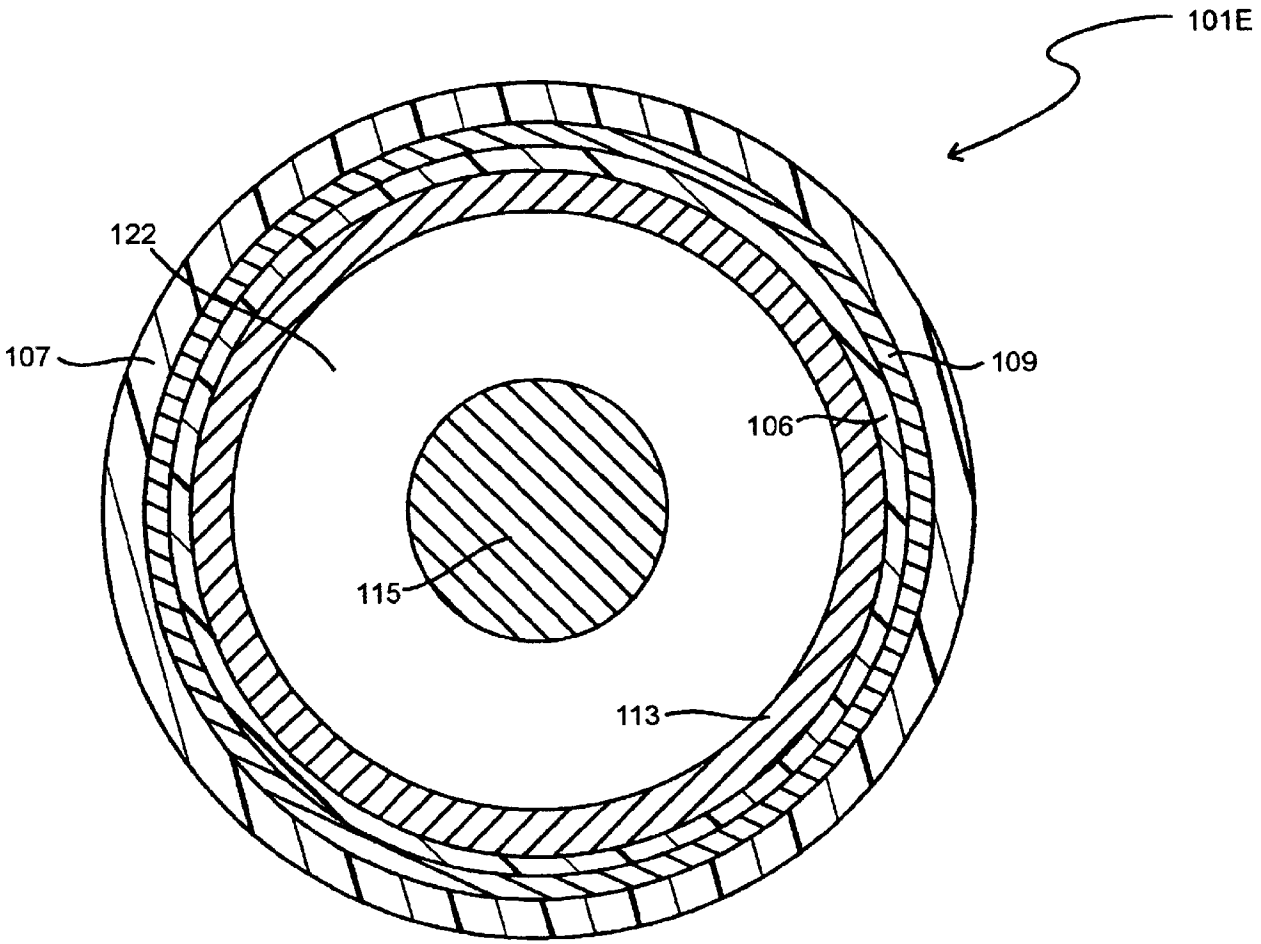
FIG. 6 is a second cross-sectional end view of the conductor and insulator elements of a segmented barrel-style plug, as in FIGS. 1A, 1B, 2, 4, and 5, showing their interrelationship.

In FIGS. 3 and 6, once an external power supply 152 has acquired voltage information from a battery 166, the power supply configures its output voltage according to the optimal power signal parameters it has acquired from the battery, then delivers that power signal to the host device 168. Starting at battery 166, the positive power signal flows to receptacle spring-contact 139B. Since plug 101E is inserted, plug contact segment 109 transfers the signal at receptacle contact 139B through a diode 178 that controls the direction of flow of the power signal to be only from plug contact segment 109 to plug contact segment 105. Contact segment 105 is attached to power supply 152.

The ground line is shared by both the battery and the host device at plug center pin 115 and receptacle's conductive orifice 127. Since the configurable power supply 152 is operating within the same general voltage range as the battery 166 with which it shares a conductor, eliminating a fourth conductor is appropriate in this application.

From the power supply 152, a positive power signal travels to plug contact surface 113, then to attached receptacle spring contact 137, which is electrically available to the host device 168.

In order to provide a means of transferring backup power from battery 166 to device 168, should power supply fail to operate, a conductive shunt (?) attaches receptacle spring-contact 139A to spring contact 137. In such a configuration, shunt (?) causes a potential electrical contention, by allowing power to flow both from the battery and the power supply. This conductor allows power to flow from the battery first at receptacle spring contact 139B, then to electrically engaged plug segment 109, through diode 178 to plug segment 105, then to electrically engaged receptacle spring contact 139A, along the shunt to receptacle spring contact 137, then to host device 168. But, plug 101E's inner conductive sleeve 113 is also electrically engaged to receptacle spring contact 137, so both battery 166 and power supply 152 are attempting to deliver power at this same juncture.

The resolution of the contention is found in Dominant Voltage principles. As discussed, as long as power supply 152 outputs a signal at a higher voltage than battery 166, the only power signal received by the host device 168 is that of the power supply. Should the power supply fail, or simply be turned off, power signals from the battery will immediately take over.

The diode is located in the plug, instead of the receptacle, so that it disappears from the receptacle's circuit paths when the plug is retracted. Note that diodes can be incorporated in a plug, or in the circuits created in, to, or from a receptacle.

Since the subject connector assembly of the invention employs a discrete "jumper" plug 167 (FIG. 8) which replaces plug 101E in FIG. 6 when external power is not in use, its conductive surfaces 173/113 electrically couple receptacle spring contact 139B to contact 137, thus re-establishing a circuit between battery 166 and its host device 168.

Principles of Operation

The principles of operation of a connector assembly that is the invention are important to defining individual implementations of the mechanical and physical connector of the present invention.

A non-limiting operation of a multi-segmented "barrel-style" plug, and its mating receptacle, are to provide a means of reconfiguring electrical (power and/or data) circuits so that devices external to a host device and its associated battery perform functions as if they were embedded in the device. Also, electrical signals from peripherals address specific device sub-systems which, without such a connector assembly, would be inaccessible to external peripherals. As in the Theory of Operation section above, mating the plug and receptacle creates an operational "Y-connector" that temporarily disrupts and reconfigures a host device's original internal circuits. Such a Y-connector can be used, for example, to monitor one or more activities of a host device (or its sub-systems) by isolating and redirecting the I/O port of that sub-system for purposes such as monitoring, powering, or sending/receiving data.

An example of a specific connector assembly function is to disrupt the power circuit between a host device and its battery. This disruption may be necessary because battery charging is not deemed appropriate at the time, or in a specific location, yet external power to the device is needed. As in the example cited in the previous Dominant Voltage discussion, the host device 168 (FIGS. 1A and B) is temporarily disengaged from its battery 166, so that an external power supply 152 can, by accessing the battery independently, as well as power the device directly. In the "Y-connector" metaphor, the power supply is at the base of the "Y," and the battery and host device are at the terminuses of each of the branches. Yet, by implementing a means of controlling the direction of flow and a simply shunt, the battery remains available to the host device.

In another example, perhaps an external power supply is input-side limited because it is drawing power from an upstream generator source (or being powered by a weak car battery while the engine isn't running). These limited power resources may not provide sufficient power reserves to both operate the host device, and simultaneously charge the host's battery. As has been previously discussed, connecting power to a host device's standard input-power port (jack), always causes the device's internal battery charger to turn on. But, by accessing the host device with the connector assembly of the present invention interposed at the device's battery-to-device interface, battery charging is disabled, and power-limited resources are conserved.

Upgrade Paths

The capabilities of multi-segmented connectors allow multiple simultaneous functions to be performed with a host device and its sub-systems (or peripherals), without requiring numerous complex interfaces. One connector assembly can deliver significant upgrades to electrical or electronic equipment for operations that were not originally designed into the device. Upgradability can be achieved simply and cost effectively by locating the connector assembly and related wiring in a removable (or easily field-replaceable) module. For example, since rechargeable battery packs are user-removable, incorporating a connector in a battery housing provides a convenient means of modifying electrical circuits, both in the battery and, as a consequence, the battery's host device.

A battery pack is not specifically shown in the figures, but it is the preferred installation modality. Another advantage of battery-mounting a connector assembly 101F (FIGS. 1A and B) is that a host-device manufacturer can inexpensively upgrade a user's battery pack with one having a receptacle 101B installed. Connector assemblies of the invention may be integrated into a host device at the time of manufacture. FIGS. 1A and B show a multi-segmented host device's power-input jack 101B that is installed in a host device.

Upgrades to install a connector 101B (FIG. 1B), or an equivalent, in an already manufactured host device can be done by qualified field service technicians. Electrical traces 157, 159, 161, and 163 would not be in place if the host device was being upgraded, so supplemental wires would be installed, or the circuit board would be replaced. However, the intent of connector assemblies discussed herein is to not have to modify existing host devices, but instead to install the preferred modalities as a receptacle in a suitable replaceable module, such as a battery pack.

While receptacle 101B is shown as if it is mounted into a host device, as a replacement for the standard power-input jack, FIG. 1B also could be viewed as a battery pack installation, with vertical panel 153 being the side wall of a battery housing. If this installation was in a battery enclosure, the circuit traces 157 and 159 would be directed to both a pair of exposed contacts on the exterior of that battery enclosure and the battery cells, while conductors 161 and 163 would be directed to the as-manufactured contacts on an exposed face of the battery housing that electrically attach to the mating contacts in the device's battery bay. The connector assembly is not limited to battery housings or mounted in host devices . . . other removable sub-systems or modules, such as the external AC/DC power adapter normally purchased with a host device, also afford upgrade opportunities as locations where such a connector-assembly may reside.

Figure 8:
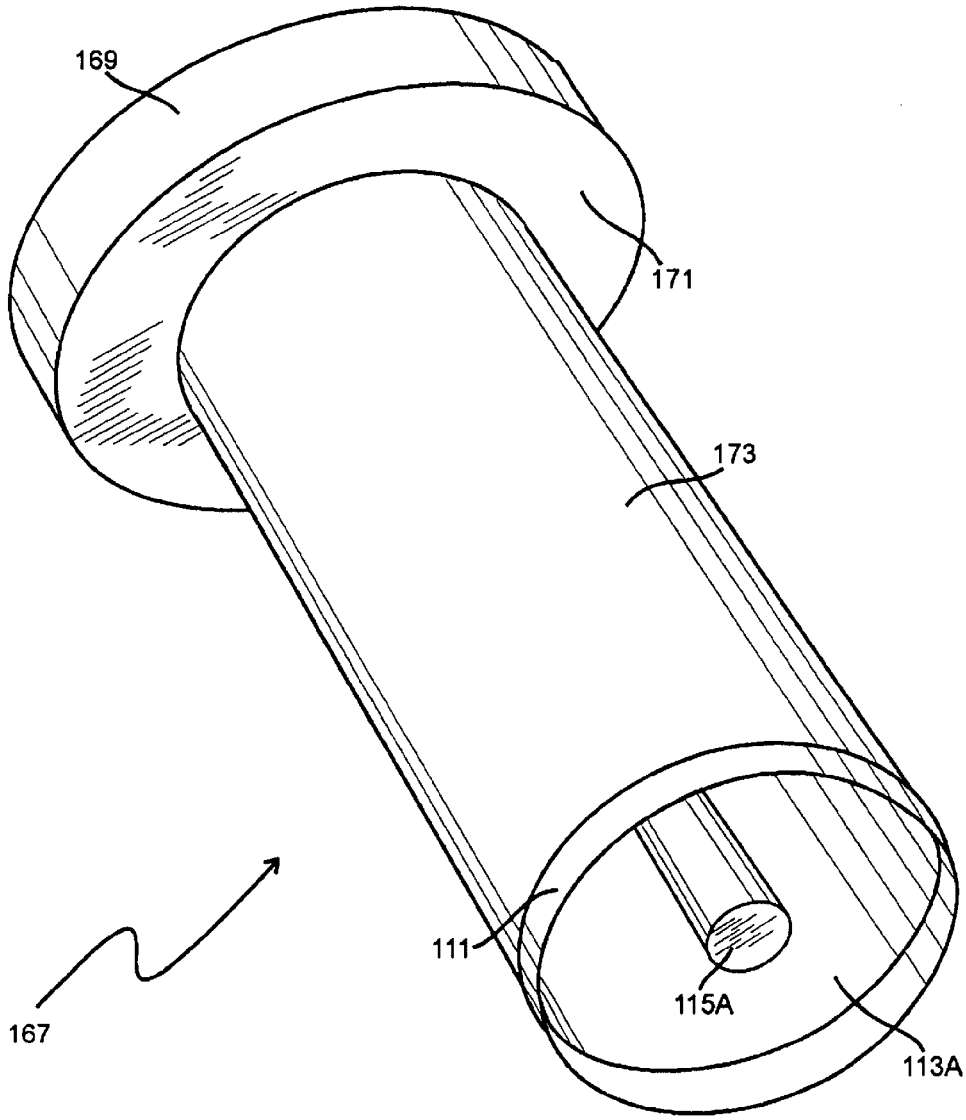
FIG. 8 shows a simple "jumper" plug that serves to re-establish electrical and/or data paths when a segmented plug, as shown in FIGS. 1A, 1B, 2, 4, 5, and 7, is removed.

Connector assemblies discussed in this document, as well as non-limiting referenced alternative modalities, are capable of establishing a "Y-connector" circuit that interrupts an existing mode of operation. Restoring the device's original circuits and operations once the plug of the subject barrel-style assembly is retracted is by means of a "jumper" plug. FIG. 8 depicts such a reconnecting jumpered plug that reestablishes the device and battery's original circuits. Referencing both FIGS. 1A–B, and 8, plug 167 has a surface 113 that is continuously conductive along the length of its barrel, while its counterpart 101A in FIG. 1A has a barrel 103 that segmented as conductive elements 105 and 109. The two segments correspond to the interior conductive surfaces of identified receptacle conductive sleeve segments 149 and 147 (see inner conductive segments 133A and 133B in FIG. 3 for a clearer view). The fully conductive barrel 173 of jumpered plug 167 in FIG. 8 causes isolated segments 149 and 147 to be recoupled electrically, thus returning a host device (and its peripherals) to the original "as-manufactured" electrical configuration.

Most connector assembly embodiments herein allow for additional features, such as "hot insertions." By the location, selection, and wiring of the plug's conductive segments along its barrel, staging electrical contacts is achievable, so that one contact is electrically active prior to a second contact. Strategic placement of insulators in plug and receptacle elements of a connector assembly provides circuit disruption, rerouting of electrical paths, and the creation of Y-connector electrical branches within existing circuits.

Multiple operating modes allow for operations similar to those of a multi-selector switch. Each branch of a Y-connector (or both together) can be used as either data or power paths, or as combined mixed-signal circuits.

Four Variables

Various embodiments of a connector assembly of the present invention are configured differently, based on four generic variables. The first variable is the desired specific function/operation of any external devices. Intended external devices, and their uses, determine the configuration and wiring of a connector assembly. For example, if there are two external devices, the first functioning as a battery charger, and the second as a power supply, the routing of power signals through the plug and receptacle elements is specific to charging a battery, and powering a host device. If the external battery-charging device is to operate independently of the power supply, then a connector assembly should be used which has at least four electrical segments (as does the barrel-style interface apparatus here). If a battery charging function, and providing power to a host device function, are to be performed simultaneously, then a four-segmented connector assembly that has a "Y-connector" capability is called for.

A four-wire cord between one or more external devices, in conjunction with a four-segment connector plug, provides two independent operations simultaneously. In some interconnect combinations, such as an external monitoring a battery while simultaneously delivering power to a host device from an external power supply, sharing conductors can extend the number of external peripherals attached beyond two. By the use of insulators to create more conductive segments, in combination with appropriately configured "jumpered" plugs that restore original circuits at the receptacle when no external peripherals are attached, a segmented barrel-style connector assembly can be designed that performs a multiplicity of diverse operations. As has already been described, the plug 101E in FIG. 7 and the receptacle 101B in FIG. 3 deliver power from an external power supply to a host device, while enabling a battery to still be engaged to its host device should the external power supply shut-down, while also disabling battery charging. Then, simply inserting jumpered plug 167 (FIG. 8) into receptacle 101B in FIG. 3 restores the original circuit between the battery and its associated host device.

The functions/operations a connector assembly of the invention performs are not necessarily the receiving or sending of an electrical signal. A disruption of an electrical path is a function, so eliminating battery charging is considered a valid function, for example. The use of insulators, "Y-connector" branching and redirecting of electrical paths, and various means of making electrical signals flow only in one direction (e.g., diodes, switches, etc.), all combine to optimize the functional and operational capabilities of a connector assembly of the invention.

An example of an application for a means of controlling signal direction flow to eliminate battery charging, would be in an aviation environment. The risks of charging high-density batteries that have historically been proven to flame or explode are well known in the aviation community. By including an N-signal switch or a diode 178 (FIG. 7), no battery charging occurs. Airlines would distribute such plug 101H, preferably with an attached power cord specific to airline use. Passengers having a non-switch-enabled plug 101H (which charges batteries) would not be able to use their plug on a plane, as only the aircraft version would attach to a specially-configured receptacle unique to aircraft operations.

Second Variable

Figure 7:
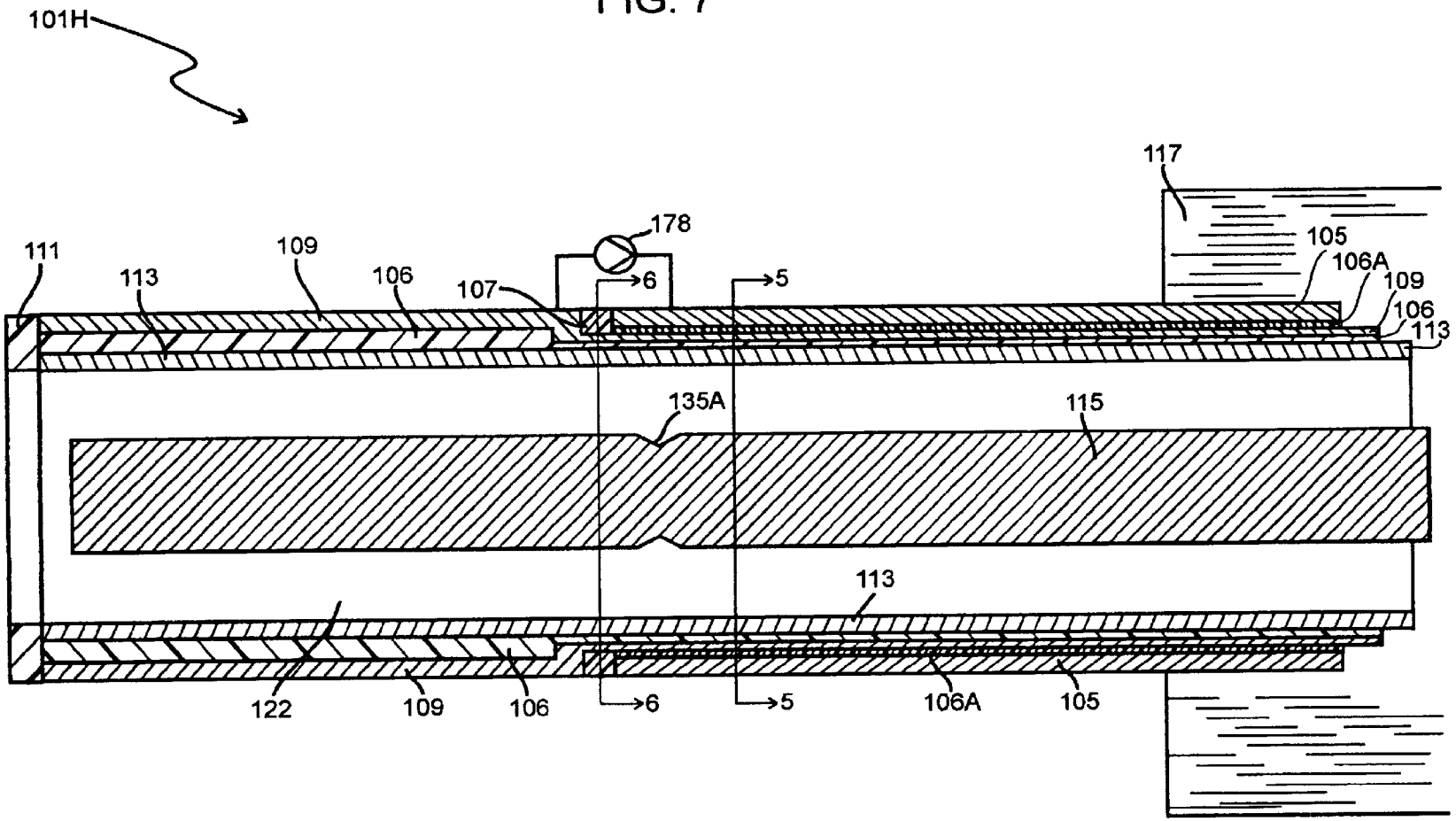
FIG. 7 depicts a cross-sectional side view of the conductor and insulator elements of a segmented barrel-style plug, as in FIGS. 1A, 1B, 2, 4, and 5, showing the interrelationship of the elements.

The second variable relates to the number of segments on a plug (and on a corresponding receptacle). One of the differentiators between a connector assembly of the invention and other connector apparatuses is an ability to create new circuits with a minimum of connector contacts. For example, FIGS. 1A, 2, and 4–8 depict a plug comprised of a plurality of conductive segments, separated by insulators. FIG. 7 depicts a longitudinal cross-section of one such plug constructs. The conductive external contact segments 109 and 105 are electrically isolated by an insulator ring 107. However, the conductive interior contact 113 is not segmented, but is contiguous and extends the entire length of the barrel 101E. Also with the center conductive pin 115, which is a single element along the barrel's length.

Expanding the operational capabilities of such a plug is easily achieved by any/all of the following:

- Design-in more insulators. Placing more insulator rings 107 along the exterior length of the barrel creates more exterior conductive segments (e.g., resulting in a hypothetical construct of original segments 109 and 105 with newly created segments 109A and 105A (not shown).
- Extend the thickness of an insulator 107 to disrupt contiguous interior conductive element 113 so as to create hypothetical segments 113 and 113A.
- Segment center pin 115 by introducing one or more insulators along its length.
- Convert conductive plug segments to insulators. Certain functions/operations are easier to achieve if an insulator disrupts an existing circuit. For example, a battery charging peripheral attaches to the connector assembly so as to introduce an insulator along the conductive path leading to the host device, thus effectively isolating the battery for purposes of charging. Note: a similar result is achieved by configuring the conductors of the plug to not attach to every available conductive contact segment.
- Using one or more plug contact segments as conductor-less jumpers to re-attach previously electrically uncoupled devices, sources, or peripherals at the receptacle.
- Gang multiple device conductors at a single conductive contact segment. A shared ground is obvious, but a shared positive-signal conductor is practical if one branch of the "Y"-connector is controlled as to its direction of signal flow. Also, ganging devices on a single conductive segment works well for monitoring-type operations. For example, an external monitoring peripheral is attached into an existing circuit between a "smart" battery and its data-enabled host device, in order to monitor data signals being bi-directionally transferred between the battery and its host device. IN concept, this interconnecting configuration is diagrammatically more a "T"-connector than a "Y"-connector. For clarification, herein a "T"-connector does not disrupt an existing electrical circuit, while a "Y"-connector can disrupt, redirect, and/or create new electrical paths.

All of the above methodologies apply to the receptacle, and designers and manufacturers of the interface apparatus of the present invention should pay particular attention to a properly-designed receptacle that can accommodate multiple diversely-configured plugs, each dedicated to specific functions/operations.

The connector assembly of the invention can function with at least one contact, that single contact being a jumper, as is illustrated in the plug in FIG. 8. Reconnecting discrete paths with jumpers or terminator blocks compares to the use of diodes, but jumpers have the advantage of allowing bi-directional electrical signal flow along a circuit, whereas a diode can only establish a one-way path.

Depending on the function to be achieved, an interface apparatus can function with no conductive contact elements at all. For example, the obverse of the jumper plug 167 in FIG. 8 is comprised of at least one attachable segment or surface that is non-conductive. Unlike the previous discussion regarding introducing one or more non-conductive segments into a plug configuration, with the jumper plug, there are no external conductors whatsoever for attaching peripherals, etc. By incorporating one of more insulator surfaces on a plug 167, an anticipated function/operation is disabled when the plug is inserted. For example, if the anticipated to be disabled is battery charging, then inserting a plug 167 that is configured with an insulator that disrupts the existing electrical circuit between a host device and its battery easily achieves that result. For that matter, a plug 167 can be configured so as to have no conductive elements at all—only insulators.

The role of insulators plays an important part of the operation of a connector assembly of the invention. Where such insulators are placed, and the number of them, is not limited to the examples shown in the figures, and in the text of this document.

Plugs with insulated segments, whether the plug be functional for attaching external peripherals, or a simple conductor-less jumper plug that disrupts one or more receptacle-based circuits, serve discrete purposes in enhancing the operational capabilities of the subject interface apparatus. In looking at a receptacle 101B in FIG. 3, the inward-facing spring contacts 139A and 139B, as well as the outward-facing spring contact 137 function not only to assure solid electrical attaching of the mating plugs surfaces thereto, but these contacts can be designed to electrically engage adjacent conductive surfaces when no plug is inserted. For example, outward-facing spring contact 137 can easily be designed to engage the adjacent surface of conductive segment 133A (or B), thereby automatically closing a circuit. The same approach also applies to inward-facing spring contacts 139A and/or B, either or both of which can be designed to electrically engage adjacent conductive surface 130.

These configuration capabilities aptly illustrate the flexibility such a barrel-style, multi-segmented connector assembly presents to designers and manufacturers.

Third Variable

The third variable that determines the configuration of an interface apparatus and its related wiring, use of diodes, insulators, segments, etc., is the number of contacts in a preexisting battery-to-host circuit. Simple two-contact battery packs (or battery holders) are easily addressed. But, even non-data-enabled batteries have more than two discrete connector contacts, with additional contacts dedicated to charging, voltage splitting, sensing. "Smart" battery connectors typically have three data and two power contacts, but only four contacts usually need to be accessed.

A multi-segmented plug, such as that shown in FIGS. 1A, 2, 4, and 5–7, support both power and/or data functions. The use of insulators in mixed-signal operations applies to disrupting data conductors, as well as power. For example, disrupting the Clock (C), or Data (D) line may be just as effective a means of temporarily disabling battery charging as is causing a power signal to be disrupted.

Typically, a convenient way to minimize the number of contacts/conductors in a connector assembly is to incorporate a means of controlling the direction of signal flow, primarily diodes and switches.

Another advantage of using switches and diodes is that multiple external peripherals can co-exist in the same circuit created by the connector assembly. An N-signal switch, which is activated by the presence of an electrical signal at the input side of the switch, provides a means of accessing an external monitoring peripheral. It is desirable to have a battery-monitoring peripheral accessible to more than one other peripheral in the circuit, because the invention relies heavily on acquiring battery information. An N-signal switch helps selectively interconnect an external peripheral to a battery and/or a host device.

For example, by using an N-signal switch, both an external power supply and an external battery charger peripheral access the monitoring peripheral in order to acquire battery (or host device) information. The power supply accesses battery power-output information available at the monitoring device, in order to configure its output signal to the host device. On the other hand, the battery charger accesses the same monitoring peripheral for battery-charging information in order to deliver an appropriate charging signal to the battery.

FIGS. 1A and B illustrate a modality of the connector of the present invention that uses four-conductors, so as to monitor a battery while simultaneously delivering power to a host device. The same functionality can be achieved by incorporating an N-signal switch that responds to the application of power by switching a pair of power pins. A switch so configured can be used to establish a junction between a battery and a host device, so that a Y-connection is created. This switch responds to the current flow from a battery along one branch of the Y-connector, so that it closes a circuit between an external power source and a host device. The presence of a battery in the circuit automatically triggers the flow of power between an external power device and a host device. Should the battery be removed, loss of power to the N-signal switch causes it to go open between the external power source and the host device. This adds an additional layer of safety to the connector apparatus (see the section "Cables and Muxes" below for more on N-signal switches).

Fourth Variable

The fourth variable is the determination as to where to install the receptacle.

Locating a connector element in a battery pack affords a simple upgrade for existing host devices, by simply removing the present battery pack, and replacing it with one that has been upgraded with a receptacle of the invention. This is the preferred modality but, if battery mounting is not feasible, any of the embodiments of the interface apparatus herein can be relocated outside a battery housing. A receptacle should be located in a user-accessible area of a host device, of course, if it is to serve as a primary power-input jack 101B, as depicted in FIG. 1B.

Where the circuit between a power source (external to, or internal to a host device) and associated devices is changed by interposing a receptacle is not limited to only within a battery housing.

A Multi-Segmented Barrel-Type Interface Apparatus

In my U.S. Pat. No. 6,634,896, "Method and Apparatus for Transferring Electrical Signals Among Electrical Devices" (28 Oct. 2003), a key connector 330, for example, in FIG. 20, is removed, rotated then reinserted. Connector 330 in FIG. 20 is both aligning its conductive contact 340 to either mating receptacle contact 378, or 374, thereby activating one of two electrical paths of a Y-connector. At the same time, insulator 344 is deactivating the opposing branch of the Y-connector. By comparison, the barrel-style connector assembly herein eliminates these user manipulations, thus simplifying user interaction when mating a plug.

Also in the issued U.S. patent, receptacle 414 in FIG. 21A incorporates a means of controlling the direction of electrical flow. A diode 423 allows power to flow in a direction only from a battery source to an attached peripheral 413. However, power cannot flow in the direction of battery, so that a power signal from either a host system, or an external power source, cannot travel a path to the battery while a plug is in a selected position. Once the plug is removed, as shown in FIG. 21B, power to a battery 413 can flow across spring contact beams 419 and 417, bypassing diode 423. Diode 423 in FIGS. 21A and B is equivalent to means of controlling the direction of electrical flow 178 in FIG. 7 of interface apparatus presented here.

Figure 2:
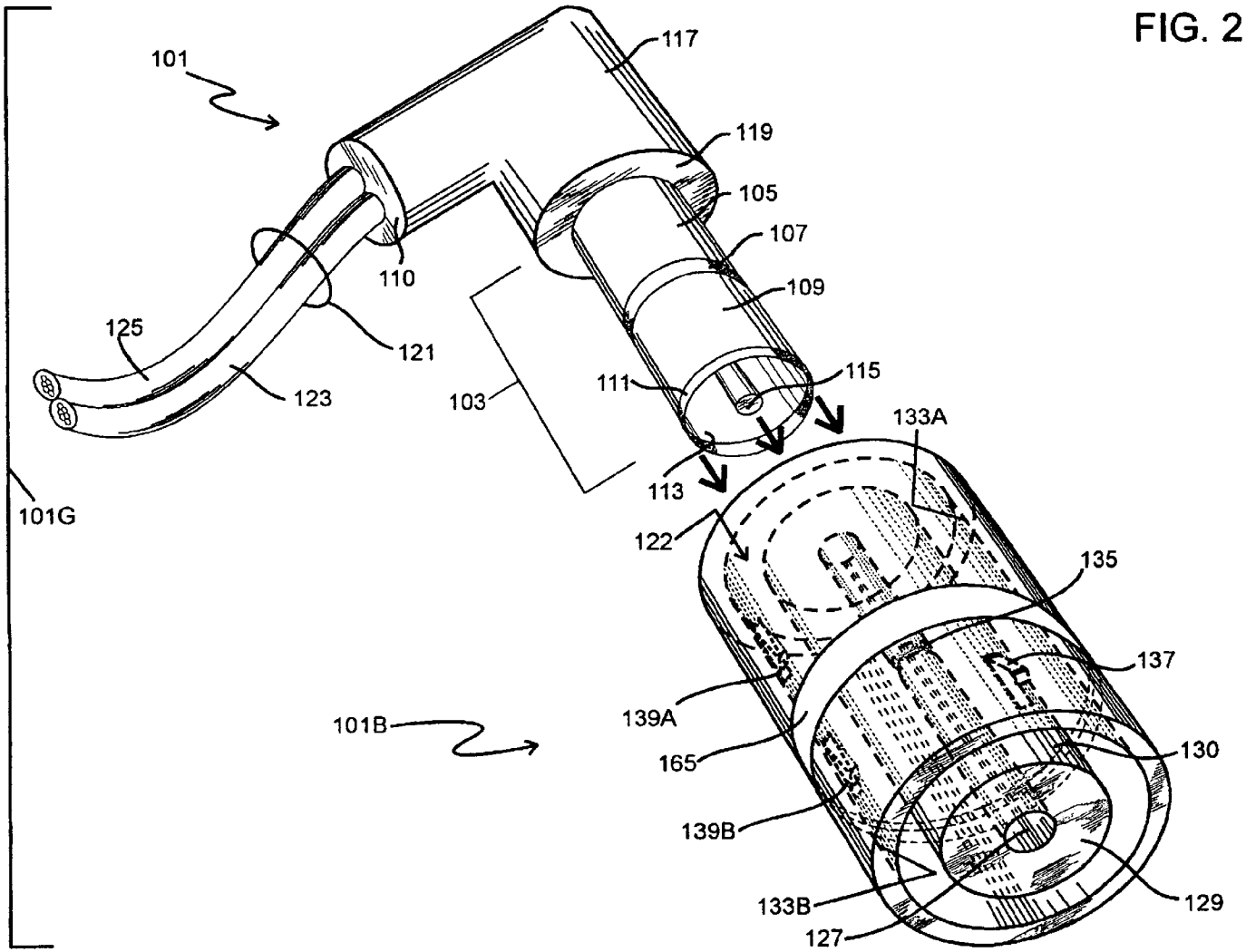
FIG. 2 details a barrel-style connector assembly as illustrated in FIGS. 1A and 1B, showing the inter-connectivity of segmented mating plug and receptacle elements.

A connector assembly, as the elements in one embodiment of the present invention, is illustrated in FIGS. 1A and 1B. Barrel-connector plug 101A is comprised of a conductive center pin 115, conductive interior sleeve 113, and conductive external contact segments 105 and 109. Mating barrel-connector receptacle 101B is comprised of conductive segments 149 and 147 (see inner conductive segments 133A and B in FIG. 3), which match and electrically couple to plug 101A's segments 105 and 109, respectively. FIGS. 2 and 3 show conductive contacts 137 and 127 of receptacle 101B that engage to plug's conductive elements 113 and 115.

Plug 101A in FIG. 1A is wired internally so that each of the four conductors 145 (123A and B, and 125A and B) is attached to a dedicated conductive segment of barrel assembly 103. For example, conductor 123A delivers its power or data signal to barrel 103's external conductive contact segment 105. Conductor 123B terminates at conductive center pin 115. Center pin 115 may be segmented, but is shown here as a single contiguous conductor. Conductor 123A and 123B are, for purposes of this example, respectively positive (+) and negative (−) power leads. By separating conductive surfaces for power at elements 105 and 115, so that one is internal to barrel assembly 103, and the other external, the possibility of an inadvertent short is minimized. Also, because center pin 115 electrically engages the receptacle prior to plug contact segment 105 doing so, staging the insertion is achieved.

Likewise, conductors 125A and 125B are attached to barrel connector external contact segment 109 (external), and conductive inner sleeve 113 respectively. This example of a typical wiring scheme is not limited to this configuration, and separation is only necessary to ensure that any mating conductive elements 105, 109, 113 and 115 of plug 101A do not create shorts as barrel assembly 103 is inserted into mating receptacle 101B.

External Devices

It is not essential to the proper operation of connector sub-assemblies 101A and 101B (FIGS. 1A and 1B) that all conductive plug elements 105, 109, 113 and 115 be attached to conductors 123A and B, and 125A and B. Connector sub-assemblies 101A and B, in such a four-wired configuration, can provide simultaneous data and/or power to both a host device 168, a peripheral 150, and the device's rechargeable battery 166.

For example, a power signal from an external power supply 152 travels along conductors 123A and B (FIG. 1A) to conductive contact segment 105 and conductive inner sleeve 113 of plug 101A. When mated to receptacle 101B, the data/power signal transfers from segment 105 to coupled outer spring contact 139A (FIGS. 2 and 3). Starting at conductor 123B, the data/power signal travels to inner sleeve 113 of plug 110A, then transfers to outer conductive surface 130 via inner spring contact 137 (see FIGS. 2 and 3).

From outer spring contact 139A and outer conductive surface 130, the respective data/power signals then flow to conductive traces 161 and 163 (FIG. 1B). Conductive traces 161 and 163 are, for purposes of this non-limiting example, attached to host device 168. Thus, a device is powered by two of the four conductors of interface apparatus 10 IF.

As to the remaining two conductors in FIGS. 101A and B for transferring data and/or power signals, conductors 125A are attached to an external battery charger 156. A charging power signal travels along conductors 125A and 125B to barrel assembly 103's external conductive contact segment 109 and center pin 115, respectively. Plug 101A is mated to receptacle 101B, causing the charging signal to transfer first from contact segment 109 to outer spring contact 139B (see FIGS. 2 and 3). Center pin 115 of plug 101A electrically couples to conductive receptor tube 127 (FIGS. 2 and 3) of receptacle 101B. The charging signal is then delivered to conductive traces 157 and 159 (FIG. 1B), that terminate at battery 166.

Thus, both a host device and its associated battery transfer data and/or power signals to an externally-attached peripheral so that the device is powered and that battery is charged simultaneously through one interface apparatus.

It is not necessary that there be two discrete external devices, nor need there be both a rechargeable battery and a host device available in order to achieve functionality from the connector apparatus 101F in FIGS. 1A and B.

Data Acquisition, Then Power Delivery

The following non-limiting example shows the interface apparatus of the present invention in a modality that requires all four conductors 123A and B, and 125A and B of plug 101A in FIG. 1A. Conductors 123A and B are data lines which terminate along barrel assembly 103 at respective plug contact segment 109 and center pin 115. Conductors 125A and B are power lines that terminate along barrel assembly 103 at respective plug contact segment 105 and conductive inner sleeve 113.

At receptacle 101B of FIG. 1B (reference FIG. 3 for detailed elements), a "smart" battery 166 and its host device 168 are separately attached to the receptacle by four conductors each (two for data and two for power). Thus, a first battery data conductor (and a separate first host device data conductor) both terminate at receptacle outer spring contact 139B, while a second battery data conductor (and a separate second host device data conductor) both terminate at receptacle conductive receptor tube 127. For power, a first battery power conductor (and a separate first host device power conductor) both terminate at receptacle outer spring contact 139A, while a second battery power conductor (and a separate second host device power conductor) both terminate at receptacle contact 139A. A means of controlling the direction of signal flow 178 (FIG. 7) is installed along the battery's first power conductor, so that power (and data) flows only from the battery.

Thus configured, when plug 101A is mated to receptacle 101B (FIGS. 101A and B), a first data signal from battery 166 available at receptacle outer spring contact 139B transfers to electrically coupled plug contact segment 109, then along conductor 123A to a configurable power supply 152. A second data signal from battery 166 at receptacle conductive receptor tube 127 to transfer to electrically coupled plug center pin 115, then along conductor 123B to power supply 152.

Power signals from the battery are also required to communicate data. A negative-polarity power signal from battery 166 is available at receptacle inner spring contact 137 and transfers to electrically coupled plug inner sleeve 113, then along conductor 125B to power supply 152. A positive-polarity power signal from battery 166 flows through the means of controlling the direction of signal flow 178, then is available at receptacle outer spring contact 139A to transfer to electrically coupled plug contact segment 105, then along conductor 125A to power supply 152.

The configurable power supply 152 is data capable, with a processor and program instructions that enable this peripheral to communicate with the battery 166 and the host device 168. As a multi-function peripheral, the need for a discrete battery monitoring apparatus 154 is eliminated. Using the data flow paths already described, the power supply 152 queries the battery. Usually, the only information that the power supply needs to configure its output is the battery manufacturer's design voltage, which is stored in the battery's memory. However, the power supply may make other queries of the battery, such as state of discharge, in order to determine if the remaining battery capacity is sufficient to rely on as backup, should the power supply go off line while the device is operational.

Since the power supply 152 is fully data enabled, it could query the host device itself as to power requirements. Typically, the battery serves as Master, and the battery-powered device is the Slave, so the logic of querying the battery directly makes sense. Designers and software developers note that, when a peripheral is attached to a "smart" battery and host device, a processor-enabled peripheral attached by the interface apparatus is normally assumed to be the Master, and the host device continues to operate as a Slave. This is important in SMBus, wherein it is the battery that calls for charging and other functions. Thus, a power supply 152 is expected to participate properly with the host device in any acknowledgements, handshaking, host queries, because the power supply replaces the battery when it delivers power, and it is expected to operate as a true battery surrogate.

Power supply 152, having acquired the information it requires to configure its power output to be compatible with the battery 166's normal output, then delivers the configured power signal to host device 168 along the conductive paths already defined.

This modality of an interface apparatus 101F (FIGS. 1A and B) affords an efficient and simple way for an external, adjustable-voltage power source to automatically match the correct input voltage of a host device. By sampling the host device's battery voltage, then delivering that voltage back to the host device, automatic power configuring is achieved. The battery circuit is isolated by the connector assembly so that no power signal is delivered to the battery, but only to its host device.

Note that jumpered plug 167, as depicted in FIG. 8, will not work as shown to reconnect the original four circuits once plug 101B is retracted. The confirmation of the jumpered plug needs to be modified to allow for a conductive segment for the fourth line in the re-established circuit.

Two-Conductor Version

Batteries with two contacts are extremely common, ranging from applications in flashlights to power toothbrushes. Included in two-contact batteries are battery holders, or battery clips, that accept individual replaceable battery cells. Real world examples include low-end electronic devices, such as toys, tape recorders, TV remotes, etc. There is also a category of batteries and their associated host devices that have two primary battery contacts, but also include one or more secondary contacts. These secondary contacts, quite prevalent in devices such as battery-powered tools, are usually reserved for proper operation of free-standing rapid-chargers (as compared to mobile computing devices, which have their charging circuits integrated into the host device). For these simpler devices, an interface apparatus with two conductors is often ample.

Another prospective use of the two-conductor variant of the present invention is for attaching external fixed-voltage power supplies. The assumption is that, for example a 9.6 volt battery is common among a group of devices, such as battery-powered drills. Thus, an attachable 9.6 volt power supply would operate a number of such drills. Therefore, the interface apparatus being discussed here is for providing this class of tools a common interface, so that when the battery goes dead, a user can still operate the drill by plugging in an external 9.6 volt power supply. Integrating a receptacle such as that shown in FIG. 1B into the battery housing of the drill, so that the external power supply connects directly into the battery has an advantage in battery-powered drills. The drill's battery also serves as a counterbalancing element that prevents the drill from being top heavy and awkward to operate. So, leaving the battery in place while operating the device on external power is actually a hidden benefit.

FIG. 2 illustrates a plug 01 with a two-conductor cord 121. Conductor 123 is attached to conductive external contact segment 105, and conductor 125 is attached to conductive interior sleeve 113. Referencing FIG. 7, note interior sleeve 113 is continuous along the length of barrel assembly 103, and is not segmented. This sleeve 113 can be segmented, but the modality shown here does not require it.

Any of the four conductive plug elements 105, 109, 113 and pin 115 can be electrically attached to either conductor 125 or 123. Since only two of conductive plug elements are required with the two-conductor arrangement in FIG. 2—as compared to four-conductor cable 145 in FIGS. 1A and 1B—two non-attached conductive surfaces on barrel 103 are not electrically active. These unused conductive elements of the plug can be jumpered together, or allocated to other circuits. With conductive surfaces 109 and 115 electrically tied together, the insertion of a plug 101 into its mating receptacle 101B creates a conductive path between receptacle spring contact 139B and sleeve 127. An electrical path thus configured serves, for example, as a ground "sense" line used to indicate that the plug and receptacle are properly engaged, therefore power (or data) can be initiated.

The elements of receptacle 101B are shown in FIG. 2, and are further detailed in FIG. 3. Conductive receptor tube 127 captures plugs center pin 115. A smaller diameter restrictor ring 135 ensures conductivity, and provides a friction fit for center pin 115. Restrictor ring 135 is not essential to the operation of the connector. Insulator ring 143 electrically separates inner conductive segment 133A from 133B. Spacer 129 is comprised of non-conductive material to electrically isolate outer conductive surface 130 from receptor tube 127.

Outer conductive surface 130 mates to conductive interior sleeve 113 of barrel assembly 103 in plug 101 (FIG. 2). Conductive tab 137 provides positive electrical contact for outer conductive surface 130 to its mating interior sleeve 113. Tab 137 also adds friction to retain plug 101 when inserted. Similarly, outer spring contacts 139A and 139B of contact surfaces 133A and 133B are for engaging plug contact segments 105 and 109. Spring contacts 139A and B are directed inward, while contact spring 137 is directed outward. These conductive spring contacts are not essential to the proper operation of the connector apparatus, and can be eliminated if there is sufficient friction fit and electrical contact to all mating surfaces without them.

Two-conductor interface apparatuses shouldn't be dismissed as lacking the sophistication and flexibility of the four-conductor modalities. In applications where a shared conductor is feasible, a two-conductor connector assembly as in FIG. 2 can perform surprisingly well. For example, with the classic triangle of a host device with a two-contact device-to-battery I/O port to which is attached a removable battery, a two-conductor plug 101 and a receptacle 101B are a good choice for interfacing an external peripheral.

The wiring schema to integrate the connector construct 101G of FIG. 2 is simple. A first conductor from the battery attaches to receptacle spring contact 139B (FIG. 3 affords a better view of the detailed elements of the receptacle). When mated, external conductive contact segment 109 of plug 101 engages spring contact 139B, thereby transferring the first battery signal to the plug. A means of controlling the direction of flow of electrical signals is strapped across plug contact segments 109 and 105, so that the signal flow is directed only from the battery to the external peripheral. Plug conductor 123 transfers the battery signal to the external power supply.

The host device's first conductor is attached to receptacle spring contact 139A, so that the first host device signal transfers to plug external contact segment 105. Note that this configuration connects the host device downstream of the diode that is strapped across the plug's contact segments 109 and 105, so attaching the host device to contact segment 105 allows the peripheral-to-host device electrical path to not be impacted by the diode.

The second battery conductor is directed to receptacle spring contact 137, so that the second battery signal is then transferred to plug's mating conductive inner sleeve 113, then further along the second conductor 125 to the external power supply.

The host device's second conductor attaches to receptacle spring contact 137, just as did the battery's second conductor. And, as with the battery, the second electrical signal from receptacle contact 137 transfers to mating conductive inner sleeve 113 of plug 101, the along conductor 125 to the external power supply. In the overview, the battery and host device share both of the two available conductors, both being attached electrically at the terminus of each conductor. Note that an unused element of the plug and receptacle are unused. Conductive center pin 115 at the plug and mating conductive receptor tube 127 can be used if separate positive signal; paths are desired, but that approach comes with the cost of adding a third conductor between the external power supply and the plug.

Thus, except for the diode interposed across plug contact segments 109 and 105, both the battery and host device are both electrically coupled to the same two conductors. Further, since the diode allows a battery signal at plug contact segment 109 to flow to adjacent contact segment 105, to which host device is also electrically coupled, battery power signals can flow from the battery to the host device at any time. Thus, battery power is always available to the host device. As a matter of fact, battery power flows to the host device whether or not a plug 101 of FIG. 2 is inserted or not! An ideal configuration for battery backup, in that even should the attached power supply fail or shut down, battery power is immediately and automatically flowing to the host.

Because the diode causes a slight drop in voltage, the uninterrupted power supply implementation that results from the interface apparatus configured this way is not perfect, but it will suffice. The small voltage loss attributable to the diode is easily overcome by simply inserting a jumpered plug 167 (FIG. 8). This rectifies the diode-loss concerns as power flows along the continuous external conductive surface 173 of the jumpered plug, thereby allowing the power signal to flow along the lower impedance conductive element 173 instead of through the higher-impedance diode. How this arrangement of the two-conductor plug operates, refer to the previous section titled "Theory of Operation."

Interchangeable and Replaceable

Figure 4:
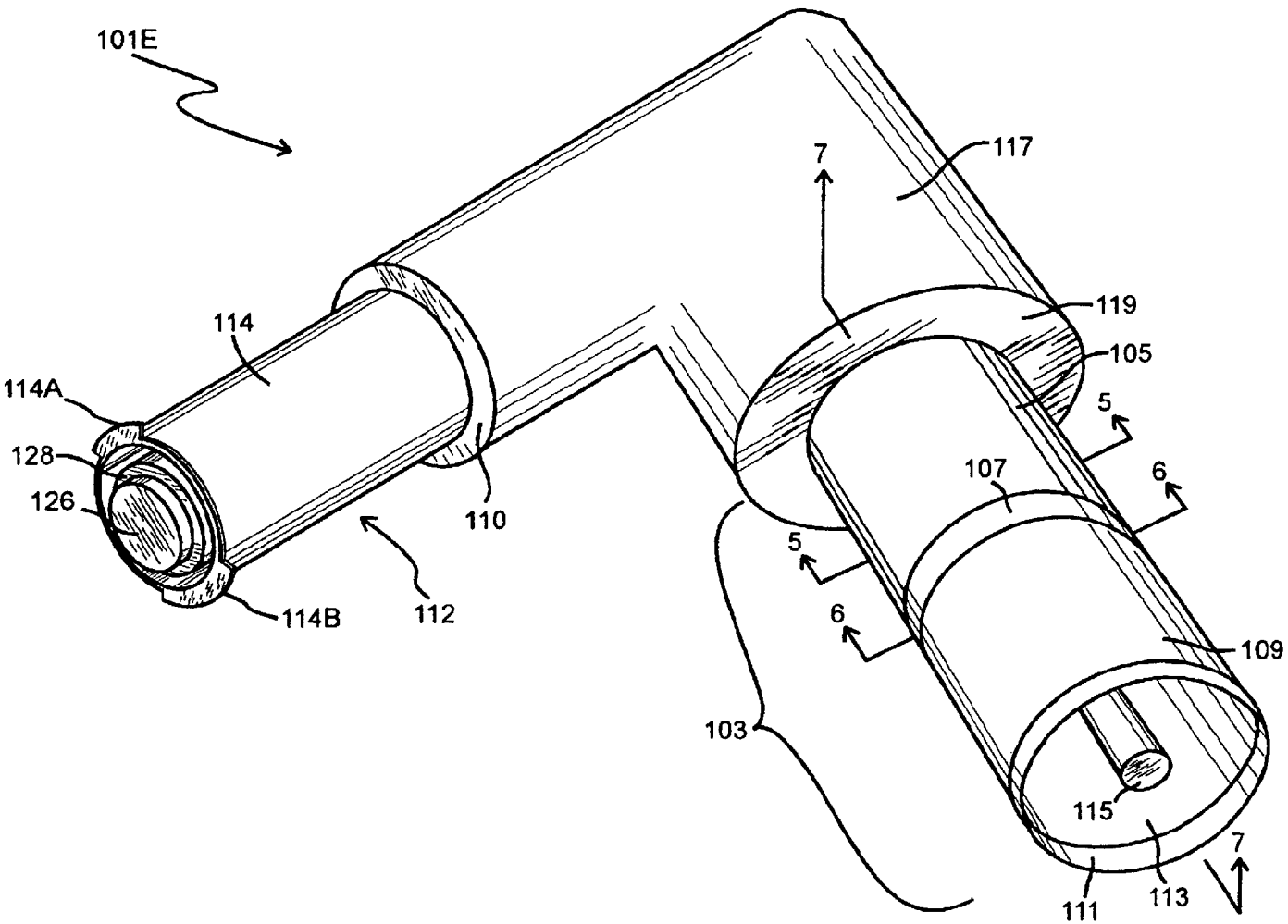
FIG. 4 depicts a plug that has segmented barrel and pin electrical contact elements, as in FIGS. 1A, 1B, and 2, as well as a simple means of making such connector plugs removable and replaceable on a cord.

Plug 101E in FIG. 4 details the elements of a connector comparable to that of FIG. 2. Insulated boot 117 is shown as a 90-degree angled backshell, but the boot can be configured in any style or shape that allows for convenient insertion and removal of plug 101E. Insulator 111 provides a non-conductive tip to barrel assembly 103, as is typical of most barrel-style plugs.

Plug 101E in FIG. 4 features a "twist and lock" cylindrical base 112 that affords easy removal and replacement of the entire plug sub-assembly. Cylindrical base 112 is comprised of outer conductive shell 114, and inner conductive post 126, for transferring power (or data) signals from any of the available conductive elements (105, 109, 113, and 115) on barrel assembly 103. An insulator layer 128 prevents shorting of conductive post 126 to conductive shell 114. The subassembly comprised of elements 128 and 126 may be spring loaded, so that conductive post 126 extends slightly past the aft edge of outer shell 114. Two flanges 114A and B provide a twist lock attachment to a mating receptacle (not shown).

By making plug connector 101E removable, variants of such plugs having different wiring and contact configurations to accommodate various applications are easily interchanged. Interchangeability is important, since host device designers historically have used a distinctly different connector assembly for every electrical or electronic product, even to changing to a different connector apparatus for each model of these products. The reason for such behavior is understandable. A vendors laptop model #1 operates at 9.6 VDC, model #2 requires a 12-Volt DC input power signal, while model #3 uses 18 VDC and all three of these models may be offered simultaneously in the marketplace! In order to avoid voltage mismatches from look-alike AC/DC power-conversion adapters, the manufacturer installs a different receptacle at the device, and builds the adapter with a plug that only fits that receptacle, so that a user cannot (theoretically) attach a mismatched power source to any of the devices.

That concept was sound, until the entire universe of available connector assembly variants (approximately 50), had been consumed by the first 50 models of the device. At that juncture, a new and previously unused connector was not used on the 51st model of the device. Instead, the vendors simply went back into the pool of already in-use connector assemblies, thus causing the very problem of incompatible devices and power-conversion adapters that the vendors were originally trying to avoid. Today, there are over 300 laptop variants, which mathematically means that there are likely five AC/DC adapters that will mechanically connect to a given host device, but which output an incompatible power signal.

Interchangeable and replaceable plug 101E in FIG. 4 provides a simple, reliable, and low-cost solution to this adapter-to-device incompatibility dilemma. The flexibility in configuring a receptacle and matching plug of the barrel-style interface apparatus enables vendors to individualized connector solutions. Which contact points conductors attach to, integration of various means of directing signal flow, number of conductors used to achieve a specific application, insulating certain contacts by not attaching a conductor (or, in the obverse, attaching multiple conductors to a single shared contact), jumpering contacts, individualizing a jumpered plug, adding more insulator rings to expand the number of available contacts, etc., all contribute to enabling a vendor to continue the "one-device-per-distinctive-connector" paradigm. But, by continuing that paradigm, the issue of available plug variants is controlled by a removable plug 101E as in FIG. 4.

The combination of a barrel-style interface apparatus and a configurable power supply should serve to bring a more rational approach to the connector-selection behavior of device designers and manufacturers. Replacing the ever-growing legion of distinct AC/DC power-conversion adapters is at the root of solving the problem. An external configurable power supply 152 (FIG. 1A) that can automatically output any power signal across a wide range of voltages is pivotal. This universal, "plug 'n play" power adapter—configured with an onboard A/D converter (and/or "smart"-battery-compliant communications capabilities), a processor and appropriate program instructions—first queries any previously unknown host device's battery to determine the power requirement of the device. Then, after configuring a power supply 152's power output signal, delivers a battery-compatible power signal to the host device at the device's battery I/O port. A power supply 152, thus configured and in conjunction with the barrel-style interface apparatus herein, anticipates potential plug-receptacle electrical mismatches. A receptacle that is mechanically compatible (i.e., the mechanical fit is proper when mated to a plug 101E), has to be properly wired so that an external power supply 152 can access a battery. Since the first state of the power supply is to poll a battery in order to determine the power supply's output, only receptacle and plug configurations that causes battery signals to flow to the power supply will result in the power supply proceeding to its second state of power configuration. Since the receptacle just connected to inherently must be configured to enable signal flow between the battery and its host when a plug 101E is not engaged, then it is assumptive that if the battery signal flows to the external power supply, that a signal sent from the power supply back to the receptacle will correctly flow to the host device. See my U.S. Pat. No. 6,459,175 "Universal Power Supply," (1 October 2002) for additional safeguards in the power supply that insure that a suitable electrical circuit between the power supply and an attached host device is in place prior to the power supply outputting its configured power signal.

By implementing this one-size-fits-all power adapter solution, the underlying adapter incompatibility issue will inherently lead to the host device industries discontinuing their already-failed distinct connector paradigm. In the meantime, the interchangeable plug 101E in FIG. 4 provides an interim and transitional solution, whereby a user can simply switch a plug sub-assembly to match a device's receptacle.

Internal Views

Cross-sectional views 5—5 (FIG. 5), 6—6 (FIG. 6), and 7—7 (FIG. 7) of plug 101E's barrel assembly 103 (FIG. 4) shows a construct of insulator layers and conductive surfaces.

Figure 5:
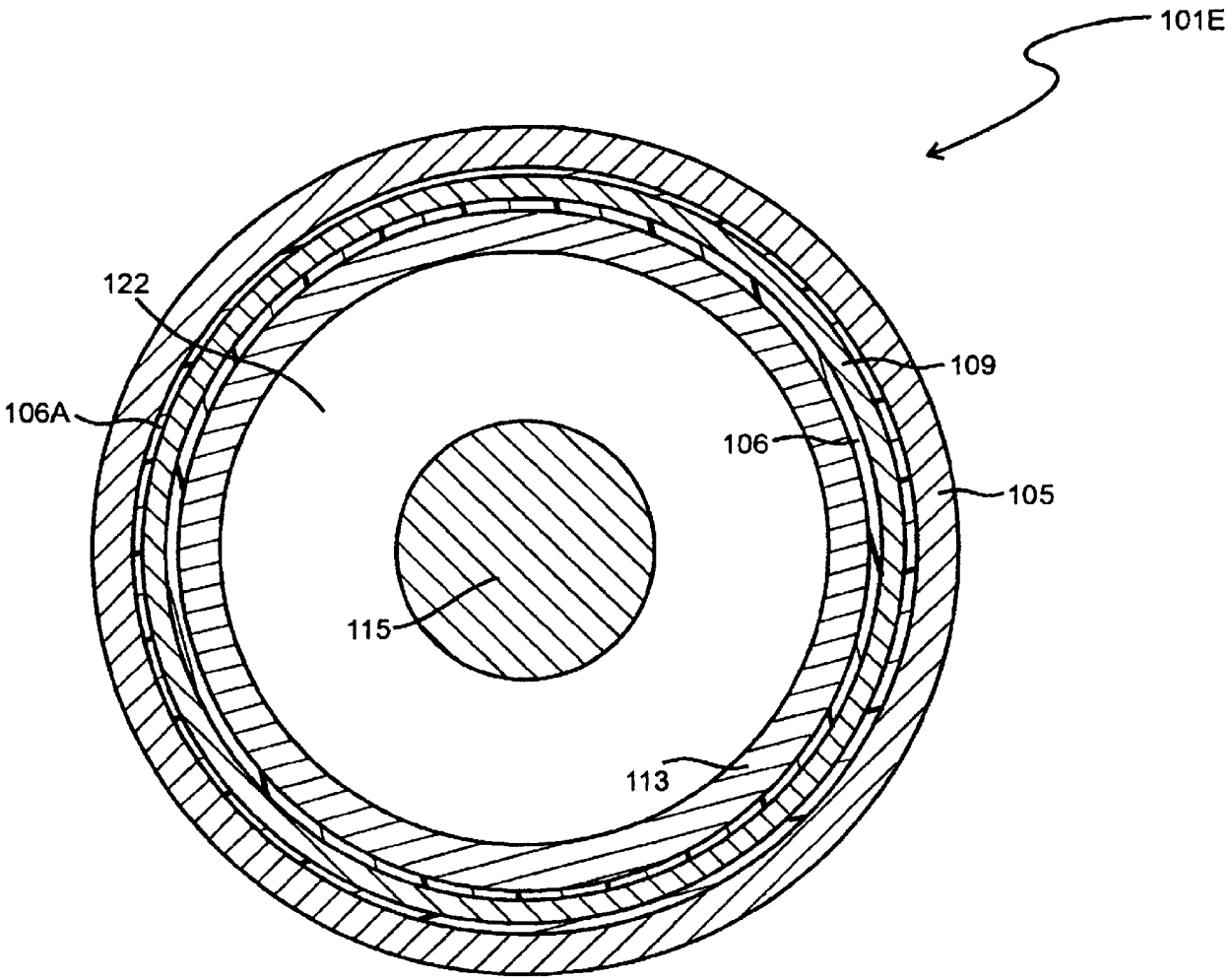
FIG. 5 is a cross-sectional end view of the conductor and insulator elements of a segmented barrel-style plug, as in FIGS. 1A, 1B, 2, and 4, showing their interrelationship.

The first view of barrel assembly 103 is shown in cross-sectional view 5—5 in FIG. 5. Conductive center pin 115 is surrounded by open space 122. The inner perimeter of this open space is where receptacle conductive receptor tube 127 of receptacle 101B in FIG. 3 engages center pin 115. The outer perimeter of this open space is where the receptacle's outer conductive surface 130 engages plugs conductive inner sleeve 113, and this conductive sleeve runs the length of barrel assembly 103 (see cross-sectional view 77 in FIG. 7). Conductive sleeve 113 is electrically isolated from conductive layer 109 by insulator layer 106. It should be noted that insulator 106 is not continuously expressed at this thickness along the entire length of barrel assembly 103 (compare element 106 in FIG. 6, and see cross-sectional view 7—7 in FIG. 7).

"Conductive layer" 109 shown here is not the same as the actual exposed conductive contact segment 109 depicted in FIG. 4. This layer 109 is the continuation of the conductive element that runs along the length of the barrel assembly and terminates in the backshell of the plug, where a conductor is attached. See the designated cross-section identifier 5—5 in FIG. 7 for more details. In FIG. 4, the designated location of this cross-sectional view 5—5 places conductive external contact segment 105 at the outermost perimeter of the plug representation in FIG. 5. When mated to a receptacle 101B (FIG. 3), inner conductive segment 133A engages the outer surface of plug contact segment 105. View 6—6 in FIG. 6 shows a further cross-sectional representation of the interrelationships of elements in a plug 101E (FIG. 4 and elsewhere). Unique to this view is the plug's outer insulator ring 107 that electrically isolates external conductive contact segment 109 from its longitudinal counterpart contact segment 105 further back along the length of barrel assembly 103. As in FIG. 5, the "conductive layer" 109 is not the same as the actual external conductive contact segment 109.

Longitudinal cross-section view 7—7 in FIG. 7 illustrates barrel assembly 103. Ring-type insulator 111 at the insertable tip of the plug protects from damage (including inadvertent electrical shorts), and the ring also facilitates insertion. External conductive contact segment 109 transitions at its juncture with insulator ring 107 to a smaller-thickness "conductive layer" that is electrically isolated from adjacent conductive contact segment 105 by a second insulated layer 106A. Conductive segment 109 is electrically isolated from conductive inner sleeve 113 by an insulated layer 106. Notice that insulated layer 106 also changes its thickness profile near the juncture of insulator ring 107, so as to allow space in the total thickness of the plug assembly to accommodate contact segment 105. Thus, the two external conductive segments 109 and 105 maintain a uniform diameter along the length of barrel assembly 103.

The open space 122 in FIG. 7 is, as previously mentioned, for receiving a receptacle 101B's central sub-assembly (FIG. 3), which is comprised of an outer conductive surface 130 (which engages plug's conductive inner sleeve 113). Receptacle's conductive receptor tube 127 engages plug center pin 115. The insulated spacer shown in receptacle 101B of FIG. 3 is an end plate that keeps the outer conductive surface and the central tube aligned. There is a space that electrically separates outer surface 130 and the receptor tube 127. This space can either be open so as to form an insulator between the conductive elements 130 and 127, or the space can be filled with insulating material 121 to not only electrically isolate, but to provide additional structural rigidity to this center construct.

In this view in FIG. 7, it is apparent that conductive inner sleeve 113 can be segmented to provide further discrete segments along the length of the barrel assembly for further conductors, or to create insulator surfaces along this inner sleeve 6. The same is true of center pin 113, which also can be easily segmented to enable further expansion of the plug's capabilities for interfacing with a multiplicity of attachable external peripherals, sources, and devices.

Terminator

FIG. 8 shows a "jumpered" plug 167 that serves as a terminator element to reconnect the circuits at a receptacle 101B in FIG. 1B (and 101B in FIGS. 2 and 3). Terminator plug 167 has no external wires, but is internally "jumpered" so that the open circuits in the receptacle that couple conductive traces 161/157, and 163/159 in FIG. 1B, are reestablished by the insertion of a plug 167.

For example, the four-conductor cable 145 attached to plug 101A (FIG. 1A) has conductors 123A and 125A that are both of the same negative polarity, and each is respectively attached to conductive segments 105 and 109 are polarity matched (positive) by being connected each to conductors 123A and 125A. Inserting the plug into a receptacle 101B (FIG. 3) causes the plug's conductive segment 105 to engage with receptacle's outer spring contact 139A, which is at the terminus of conductive trace 157 (FIG. 1B). Plug's conductive segment 109 engages outer spring contact 139B at the receptacle, which is at the terminus of conductive trace 163. These two conductive paths form the positive polarity section of the circuit between battery 166 and host device 168 (FIG. 1B).

Continuing the example, conductors 123B and 125B are also polarity matched (negative), and are each respectively terminated at the plug's inner conductive interior sleeve 113, and center pin 115. Inserting the plug into a receptacle 101B (FIG. 3) causes the plug's conductive segment conductive sleeve 113 to engage with receptacle's inner spring contact 137, which is at the terminus of conductive trace 159 (FIG. 1B). Plug's conductive center pin 115 engages conductive receptor tube 127 at the receptacle, which is at the terminus of conductive trace 161. These two conductive paths form the negative polarity section of the circuit between battery 166 and host device 168 (FIG. 1B). Once a plug 101A (FIG. 1A) is retracted from its mating receptacle 101B (FIG. 3), the circuit that attaches battery 166 and host device 168 is open. A jumpered plug 167 (FIG. 8) must be inserted to electrically reattach the battery to its host device. In the connectivity schema of the above example, reconnecting the battery and host device is achieved by configuring plug 167 to re-attach receptacle spring contact 133A with spring contact 133B. The contiguous external conductive surface 173 achieves that re-connection without any jumpers internal to plug 167. The restored circuit now allows a negative-polarity power signal from battery 166 to flow along conductive trace 157 (FIG. 1B) to receptacle outer spring contact 139A (FIG. 3), which signal then transfers to engaged external conductive surface 173 of jumpered plug 167 (FIG. 8) so that by flowing along this conductive surface, the signal is then transferred to engaged receptacle contact 139B (FIG. 3), then finally the signal travels along conductive trace 163 to host device 168, thus completing the negative-polarity signal transfer along a now restored electrical circuit between battery 166 and host device 168.

Because the jumpered plug 167 is inserted, a positive-polarity power signal originating at battery 166 flows along conductive trace 159 (FIG. 1B) to receptacle inner spring contact 137 (FIG. 3), which signal then transfers to engaged conductive inner sleeve 113A of jumpered plug 167 (FIG. 8). A simple shunt that electrically couples inner sleeve 113A to center pin 115A at jumpered plug 167 allows the signal to flowing through the plug to receptacle's conductive receptor tube 127 (FIG. 3), from which the signal travels along conductive trace 161 to host device 168, thus completing the positive-polarity signal transfer through a now restored electrical circuit between battery 166 and host device 168.

In another modality that assumes an external power supply 152 and an external charger 156, a four-conductor plug 101A (FIG. 1A) and its mating receptacle 101B (FIG. 3) configured as above, are operationally capable of using the external power supply as a dedicated peripheral specifically for powering a host device 168 while, simultaneously, the external battery charger independently charges a battery 166. This configuration is optimized by integrating the charging circuit (with a separate output) into the power supply. The charging element of this assembly also serves to acquire battery characteristic information for use by the power supply in order to configure its output.

Once the external power supply and charger are disconnected, inserting a "jumper" plug 167 (FIG. 8) re-establishes the electrical circuit between the host device and its now recharged battery. When inserted into a receptacle 101B in FIG. 3, configured to be compatible with the polarities at the contact points indicated above, jumpered plug 167 renders a receptacle electrically "invisible."

While not shown, affixing a jumper plug 167 (FIG. 8) to the molded backshell 117 of a plug 101E (FIG. 4), would make the jumper plug conveniently available, and eliminate any risk of losing this connector element.

Size Is Important

A reasonable mounting location for a receptacle 101B (FIGS. 1B and 3) is in an existing battery housing. For cell packs that use cylindrical cells, the "valley" created between two adjacent battery cells provides ample space for the barrel-style receptacle in FIG. 3. The mountable backshell 151 of receptacle 10 IB is for mounting on a circuit board 155, as depicted in FIG. 1B. The shape and size of this backshell can be modified to suit space requirements in a battery pack enclosure, or it can be eliminated entirely and only the barrel assembly is affixed (glued, double-sided mounting taped, etc.) into the valley between adjacent battery cells.

For non-cylindrical cell packs, such as Lithium-Ion (Li-Ion), these morphable cells can sometimes be re-arranged in the battery pack housing.

Of primary consideration is to integrate the receptacle so that the insertable end of the barrel is fully accessible. For battery pack housings, the most accessible area is along an exposed face of the pack enclosure. Typically in end-inserted battery packs, this is the face of the housing opposite the one that has the battery-to-host I/O port. Exact location of the receptacle should always be driven by user access to the receptacle for plug insertion, as well as a location that does not cause a plugs cable 145 (FIG. 1A) to interfere with user-operation of the host device.

For battery packs as yet to be designed, placing the receptacle's backshell 151 on a circuit board inside the battery pack housing is highly recommended If the barrel sub-assembly 101B (FIG. 3) is to be significantly reduced in size, consideration should be given to contact sizes and materials, based on current-carrying capability at power levels within an acceptable range of temperature rise. It is preferred that contact sizes be enlarged longitudinally along the barrel, since the length of the barrel assembly is less an issue than its diameter when mounting the receptacle in a valley between two adjacent cylindrical battery cells. Do not overly grow the overall length of the receptacle barrel assembly 101B, as the length of plug barrel assembly 103 (FIGS. 1A and 2) will extend as well. An excessively long plug barrel is not only more prone to physical abuse and damage but, it also can become as lever that can damage the receptacle if an excessive side load is placed on the plugs backshell 117.

Furthermore, all interface apparatuses discussed in this document and shown in the various figures, and any variants or alternative embodiments, can be installed either in a host device as a primary (or secondary) power-input port connector. The mounting space issue is less problematic if receptacle 101B is installed in a host device 168 (e.g., laptop computer) as its primary input power jack (FIG. 1B).

Any dimensional considerations or proportions indicated or suggested by any of the figures presented herein should only be interpreted as suggested relative sizes of parts or sub-assemblies. Actual size, shape, and proportions may differ depending on specific applications and implementations. So, too, will there be variations in plug-retaining mechanisms, spring contacts, attachment points for conductors, insertion/retraction staging, number and location of insulators, shape and dimensions of a plug's backshell, as well as plug and receptacle contact sizes and arrangement along the barrel assembly. For further information regarding installation of the interface apparatus, see the section "Design Considerations."

Connector Concepts

The circuits created in configuring conductor attachments at a receptacle 101B in FIGS. 1B and 3, in combination with conductor configuration at a mating plug 101A (FIG. 1A), or 101 (FIG. 2), results in a "Y"-connector that interfaces a peripheral apparatus (items 150–164 in FIG. 1A), a host device 168 and the device's battery 166.

In concept, certain interconnecting configurations are diagrammatically more a "T"-connector than a "Y"-connector. For clarification, herein a "T"-connector does not disrupt an existing electrical circuit, while a "Y"-connector typically disrupts, redirects, and/or creates new electrical paths.

As an example of a "T"-connector, an external monitoring peripheral is attached into an existing circuit between a "smart" battery and its data-enabled host device, in order to monitor data signals being bi-directionally transferred between the battery and its host device. Conceptually, in this "T"-connector configuration, the interface apparatus of the present invention is located at the intersection of the top and base bars of the "T," and electrical signals flow along the horizontal top bar of the "T," from a battery located at one terminus of the top bar, to a host device located at the other terminus of the top bar of the "T." An external peripheral is located at the terminus of the vertical bar of the "T," attached by the plug of the interface apparatus to the receptacle at the intersection of the vertical and horizontal bars of the "T." In "T"-connector configurations, the attached peripheral is has operational functions that are typically limited, such as here monitoring the signals being transferred from the battery to its host device. Thus, this example of a "T"-connector does not disrupt an ongoing inter-device operation.

"Y"-connectors implicitly have an attached peripheral(s) that is interactive, i.e., performing more than passive monitoring operations. By example, the previously cited monitoring peripheral operates through a "T"-connection because the attached apparatus is only monitoring an ongoing signal-transfer operation. However, when that same monitoring apparatus is integrated with a configurable power supply as a single attached peripheral, a "Y"-connector configuration occurs. With the interface apparatus at the juncture of the three branches of the "Y," the battery at the terminus of one of the top branches has its signal flow down the branch, through the subject connector, then down the vertical branch to its base where the attached monitor/power supply peripheral is. Because the conductor attachments of the interface apparatus' plug and receptacle are configured differently than for a "T"-connector, the original battery signal is now disrupted to the host device (albeit, the battery signal will technically continue to flow to the host device until the output signal of the power supply overrides it, causing the battery signal to be disrupted).

The battery signal is received by the monitoring element of this multi-function peripheral but, that signal is now used to configure the output signal of the power supply element, so the monitoring element is now performing more than simple monitoring . . . it is also diagnosing a received signal—more complex operations usually point to "Y"-connector than "T"-connector configurations. The power supply element delivers power, so it has an implicit interactive operation, which is another indicator of a "Y"-connector configuration, instead of a "T"-connector.

To continue the metaphor, the power supply at the base of the vertical bar of the "Y," is now the source of power for the host device, instead of the battery. The outputted power signal flows from the power supply peripheral upward along the vertical bar to the interface apparatus at the juncture of the base branch and the two top branches of the "Y." The configuration of the plugs contacts and conductors includes a means of controlling the direction of signal flow which both causes the battery signal to flow only downward along the vertical bar of the "Y" to the peripheral but, also, prevents the power supply's signal from traveling up the branch to which the battery is attached. The power signal only flows from the power supply to the host device. Thus, the "Y"-connector configuration does disrupt existing circuits, redirects signals, and creates new electrical paths.

Turning to the present interface apparatus and its various possible configurations of contacts and conductors, two non-limiting connector configuration models are detailed, one representing a "T"-connector, the other a "Y"-connector.

"T"-Connector

In a "T"-connector configuration, it is not essential to the proper operation of the interface apparatus 10 IF (FIGS. 1A and B) that all conductive plug elements 105, 109, 113 and 115 be attached to conductors 123A and B, and 125A and B. Even though there are sufficient plug and receptacle contacts to accommodate a four-conductor interface, the simple operation being depicted here of an attached monitoring device 154 accessing signal transfers from a battery 166 to a host device 168 requires only two conductors for attaching the external peripheral. For reference, FIG. 3 is the preferred drawing for viewing the details of a receptacle.

To define the horizontal top bar of the "T," battery 166 (FIG. 1B) is attached by a conductive trace 157 along which its negative signal flows to receptacle's outer spring contact 139A. Since the plug for attaching the peripheral is not yet engaged to the receptacle, a jumpered plug 167 (FIG. 8) is inserted into the receptacle. This jumpered plug closes circuits that are left open when no plug is inserted. The battery signal at spring contact 139A transfers to plug 167's external conductive surface 173, then flows along it and transfers the negative signal to outer spring contact 139B of the receptacle then, finally, the signal flows along conductive trace 163 to host device 168 (FIG. 1B).

The positive signal from a battery 166 that flows along the top bar of the "T" starts with the signal flowing along conductive trace 159 to receptacle 101B (FIG. 1B), where the signal is received at inner spring contact 137 (for reference, see FIG. 3). Since the jumpered plug 167 (FIG. 8) is inserted into the receptacle, the signal transfers to its conductive inner sleeve 113A, where a jumper (shunt, not shown) electrically couples sleeve 113A to the plug's center pin 115A. From center pin 115A, the signal transfers to receptacle's conductive receptor tube 127, which is attached to conductive trace 161 at the host device 168(FIG. 1B).

Thus, the flow of both a positive and a negative signal are transferred from a battery, across the horizontal top bar of a metaphorical "T"-connector, to a host device.

To attach a monitoring peripheral 154, the addition of which will create the vertical bar of this metaphorical "T"-connector, the jumpered plug 167 above is removed, to be replaced by a two-conductor plug 101 (FIG. 2) that is attached to the peripheral by a cable 121 that provides conductors 123 and 125.

To now redefine the signal flow of a battery 166 (FIG. 1B) in a complete "T"-connector configuration, the negative signal flows first along conductive trace 157 to receptacle's outer spring contact 139A. Since the plug 101 (FIG. 2) for attaching the peripheral is now engaged to the receptacle, the battery signal transfers from spring contact 139A to plug 101's external conductive contact segment 105, to which is attached cable conductor 123 that directs the negative signal to monitoring peripheral 154 (FIG. 1A). But, according to the "T"-connector metaphor, the host device 168 is also supposed to receive the battery signal. This is accomplished by a simple shunt that electrically couples contact segment 105 with plug's contact segment 109. Thus, the battery's negative signal also flows from contact segment 105 to coupled contact segment 109 at the plug and, since contact segment 109 is engaged to receptacle's outer spring contact 139B (FIG. 3), the signal transfers there, then along conductive trace 163 to host device 168 (FIG. 1B).

Note that plug contact segment 105 is attached to both the cable conductor 123, and the shunt (not shown) that jumpers together segment 105 with contact segment 109. Contact segment 105 is the literal juncture of the horizontal and vertical bars of the metaphorical "T," where the signals branch both toward the attached monitoring peripheral 154, and the host device 168.

The positive signal from a battery 166 (FIG. 1B) first flows along conductive trace 161 to receptacle 101B (FIG.

1B), where the signal is received at inner spring contact 137 (for reference, see FIG. 3). Since plug 101 (FIG. 2) is now inserted instead of the previous jumpered plug 167, the signal transfers to conductive inner sleeve 113 at the plug. Sleeve 113 has two attached conductors. The first is conductor 125 of cable 121 (FIG. 2), which directs the positive battery signal to the attached monitoring peripheral 154 (FIG. 1A). This conductor 125 is the metaphorical equivalent of the vertical bar of the "T." The second conductor attached to plug's sleeve 113 is a shunt that electrically couples sleeve 113 to the plug's center pin 115, so that the signal available at sleeve 113 is now available at pin 115. From pin 15, the signal transfers to mated receptacle's conductive receptor tube 127, and, from there, the positive signal that originated at the battery then flows along conductive trace 161 to host device 168.

Thus, the original flow of signals from a battery 166 to a host device 168 along the horizontal top bar of the "T"-connector is still uninterrupted and is not redirected. By attaching a monitoring peripheral 154, the battery signals are transferred to both the host device and the peripheral.

"Y"-Connector

Turning to the "Y"-connector modality of the interface apparatus, it differentiates itself from a "T"-connector by disrupting one or more existing circuits, redirecting signals (not simply splitting signals, as does the "T"-connector), or by creating new electrical paths. The plug and receptacle configuration presented here is for comparison to the above-detailed signal flow paths of a "T"-connector configuration. Here, an external monitoring device 154 (FIG. 1A) and a configurable power supply 152 are treated as one attached apparatus, the monitoring device representing signal flow from a battery 166 (FIG. 1B), and the power supply representing signal flow from it to a host device 168 (FIG. 1B). For simplicity, a four-conductor cable 145 in FIG. 1A is used, although a three- or even two-conductor cable achieves the same result, when a means of controlling the direction of signal flow is incorporated into one of the electrical paths.

The negative signal of a battery 166 (FIG. 1B) first travels along conductive trace 157 battery 166 (FIG. 1B) to outer spring contact 139A of a receptacle 101B (using the detailed drawing in FIG. 3 for reference is recommended). The spring contact 139A is, by mating a plug 101A (FIG. 1A) to the receptacle, aligned and electrically engaged to plug's conductive contact segment 105 (FIG. 1A), so the battery signal transfers to this contact segment, then flows along conductor 123A of cable 145 (FIG. 1A) to monitoring peripheral 154 (FIG. 1A).

The positive signal originating at battery 166 (FIG. 1B) first travels along conductive trace 159 (FIG. 1B) to inner spring contact 137 of receptacle 101B (FIG. 3), where the conductive inner sleeve 113 of plug 101A (FIG. 1A) is aligned and electrically engaged to receptacle spring contact 137, causing the signal to transfer to sleeve 113. Conductor 123B of cable 145 (FIG. 1A) is attached to sleeve 113, so the positive battery signal flows along that conductor to monitoring peripheral 154 (FIG. 1A).

Notice that plug 101A does not have the shunts that were used in the "T"-connector version, those shunts being used to continue the electrical path from the battery to the host device. In the "Y"-connector, the electrical paths between the battery and its host device are disrupted, and battery-signal flow is redirected from the host device to the attached external peripheral.

Having defined the outbound circuit path from the battery to an attached monitoring peripheral 154, the inbound path from the external power supply to the host is established. The negative signal from a configurable power supply 152 (FIG. 1A) starts flowing along conductor 125A of cable 145 (FIG. 1A) to its terminus at plug 101A's conductive contact segment 109 (FIG. 1A). This contact segment is aligned and electrically engaged to receptacle 101B's outer spring contact 139B (FIG. 3), causing the power supply's negative signal to transfer from contact segment 109 to spring contact 139B and, as the spring contact is attached to the host device by a conductive trace 163, the signal finally travels along that trace to host device 168 (FIG. 1B).

Thus, the negative signal from an attached power supply flows to a host device along conductors, contacts, and conductive traces that are totally separate from the electrical path between the battery and the attached monitoring device.

The positive signal from the power supply 152 (FIG. 1A) to host device 168 (FIG. 1B) starts out traveling along conductor 125B of cable 145 (FIG. 1A) to its terminus at conductive center pin 115 of plug 101A. When the plug is mated to receptacle 101B (FIG. 3), pin 115 is electrically engaged to the receptacle's conductive receptor tube 127, to which the power supply's signal now transfers, after which the signal lastly travels along conductive trace 161 to host device 168 (FIG. 1B).

Thus, implementing a "Y"-connector configuration by the way conductors are attached to selected contacts at the plug and receptacle, resulting in disrupted and redirected signals, external peripherals—whether the integrated monitoring device and configurable power supply in the above example, or even two (or more) discrete external devices—interact with both a host device and its associated battery for simultaneously transferring power (and/or data) signals through a single interface apparatus. Ganging together multiple devices is achievable by congregating a plurality of conductors at a single conductive contact element of the plug and/or receptacle. A shared ground is obvious, but a shared positive-signal conductor is practical if one branch of the "Y"-connector is controlled as to its direction of signal flow. Also, ganging devices on a single conductive segment works well for monitoring-type operations.

The section herein titled "Cables and Muxes" further explores ways to eliminate one or more of the four conductors used in this example of a "Y"-connector configuration.

Design Considerations

In designing and fabricating plug and mating receptacle contacts, the current-carrying capability of the conductive materials should be sufficient to handle the power required by a host device. With laptop computers, for example, 50-Watts is not uncommon. The "ampacity" rating (at temperature) of contacts, conductors, etc., should be optimized to not cause any power loss. The confined space limitations inside a typical battery pack might well pose potential barriers to using large-surface-area electrical contacts, or the use of heavy-gauge conductors. Space-saving flat metal zinc (or nickel-plated zinc) strip conductors is advantageous in routing receptacle powerlines inside a battery enclosure (see conductive traces 155, 157, 159 and 161 in FIG. 1B).

If a receptacle is to be integrated into a new battery pack at the design stage, then wiring troughs and space for a receptacle can be pre-planned. Since receptacles are integrated as retrofits to existing battery packs, the emphasis on selection of conductive materials is an important consideration. For retrofitting existing battery packs which cannot grow dimensionally, remolding the pack's plastic housing to allow for installing a receptacle and creating wiring troughs is a valid approach, but only if production quantities justify the additional cost.

With existing battery packs, additional space inside a pack's housing can sometimes be created by removing older, lower-capacity battery cells, and replacing these with newer, smaller (and perhaps even higher energy-density) ones. Lithium-Ion cells manufactured in 1996, for example, were twice as big, and almost half as energy-dense as Li-Ion cells manufactured in 1998.

Polymer Lithium-Ion cells, with their rectangular shape and variable form factors, can also replace existing cylindrical cells in existing battery enclosures. Rectangular cells yield more energy-density per square inch The unused space left as "valleys" between adjacent columns of cylindrical cells can be eliminated by using rectangular polymer cells, thus freeing considerable room (as much as 20% of an existing battery pack's volume) for a receptacle.

For cylindrical cells, older "sub-C"-sized cells and 18 mm cells can be replaced with 17 mm cells, or even 15 mm cells, usually without any trade-offs (and perhaps even improvements) in total pack capacity. Substituting smaller cells creates room for a receptacle and the related wiring, without having to modify the battery pack's plastic enclosure.

Those skilled in the at of connector design and fabrication will be able to fit any of the examples of the receptacle of the invention into an existing battery pack.

An interface apparatus comprising a plug 101 (A or E) (FIGS. 2, 1A, and 4) and a receptacle 101B (FIGS. 1B, 2, and 3) lend themselves to the space limitations of a battery pack. Receptacle 257 in FIGS. 5 and 6 looks large as drawn, but it will fit comfortably in most battery housings. The receptacle can be reduced in size by removing the mountable backshell in FIG. 1B.

How a battery pack inserts into its bay ("cavity") in a host device is a noteworthy consideration when designing this multi-contact connector assembly for battery pack installation. Most battery packs insert end-wise into a battery bay, leaving the face at one end of the pack housing exposed. A receptacle 101B (FIG. 1B) is accessible through an opening along this exposed face of the battery housing as depicted as prior art element 153. Packs with cylindrical cells typically have their cells stacked end-to-end in columns. A convenient "V" (in the end-view of two adjacent columns of cells) between cell columns is available as a valley for installing a receptacle and related conductors. The open end of the receptacle is situated directly behind the pack's housing wall (see FIG. 1B), and an opening in the wall provides access for the plug. With a battery pack thus configured, a user can inter-connect a variety of external peripherals through this interface. Depending on the wiring schema of the connector assembly, any external peripheral can transfer electrical signals either with a host device 168, or its battery 166—even multiple peripherals can concurrently (or simultaneously) access either/both the host and/or its battery.

Occasionally, the orientation of the cell columns in a pack are at 90-degrees to the exposed face of the inserted battery pack housing, making the valley between columns unavailable for receptacle installation. In such situations with existing battery packs, designers should consider replacing the cylindrical cells with smaller ones. As previously discussed, smaller cells may actually have more capacity than those being replaced. Another option is to replace the existing cylindrical cells with polymer ones. This approach will almost certainly bring more pack capacity, while freeing ample room for the connector receptacle. Also Lithium-Jon cells are rated at higher voltages (about double the voltage of a Ni-Cad), which means that fewer total cells are required.

Cables and Muxes

For battery packs that install by first inserting their larger top or bottom surfaces into a battery cavity (instead of sliding an edge face of the pack end-first into a battery bay), the issue of cabling is important. If the battery cavity is located on the bottom face of a host device, such as the underside of a laptop computer, then a round cable exiting from the battery bay beneath the host device is not acceptable. The cable thickness could cause the host device to not sit flush on a flat surface. Since there may not be enough clearance under a host device to route a round cable, then a ribbon cable, or a flat cable built using flexible circuit board techniques, provide the low-profile required in such tight confines. Standard ribbon data cables work fine for power delivery by tying together several of the 28-gauge conductors to provide sufficient conductivity.

As for muxes, FIGS. 1A and B illustrate a modality of a plug of the interface apparatus of the present invention that uses a four-conductor cable for both monitoring a battery, while simultaneously delivering power to a host device. The same functionality can be achieved with fewer than four conductors by incorporating an N-signal switch in the circuit. The N-signal switch operates by switching a pair of power pins on the switch in response to the application of power to the switch.

A switch so configured establishes an attached peripheral with a junction between a battery and a host device, so that a three-branched Y-connection is created. For purposes of this non-limiting example, the switch is at the juncture of the three branches of the "Y." A battery is at the terminus of the first branch of the Y-connection, the host device is at the terminus of the second branch, and a user-selectable peripheral is attached electrically at the terminus of the third branch. In this example, the attached peripheral is a multi-function device that is capable of both receiving electrical signals for monitoring battery power output, and the peripheral also has a variable-output power supply incorporated that is capable of outputting a power signal for powering the host device.

In operation, the switch is configured by receiving a power signal from the battery along the first branch of the Y-connector. The switch is thereby configured to both direct the battery's power signal to the host device along the second branch, and also to direct the same power signal to the peripheral along the third branch. Here, the peripheral is in a battery monitoring mode, which allows the peripheral to capture information as to the battery's output voltage.

Further, once the peripheral has captured battery Vout information, the variable output of the power supply is then configured to a voltage value compatible with the voltage range of the battery. When received at the switch, the power signal from the power supply along the third branch causes the switch to reconfigure the circuit to direct this power signal (instead of the battery's) to the host device along the second branch.

In this configuration of the peripheral delivering power to the host device, the need for a battery in the circuit is not essential, and the battery can actually be removed. But leaving the battery attached adds an additional layer of safety to the operation of the connector assembly because, should the power delivery from the power supply peripheral along the third branch be disrupted, the N-signal switch immediately re-establishes the previous configuration, with the battery as the source of power to the host device along the first and second branches—thus providing a battery backup capability.

For low-voltage (and/or data) signal switching, for example, a Maxim (Sunnyvale, Calif.) MAX 4518 is a type of multiplexer (N-signal switch) for use in a connector assembly circuit to eliminate conductors. Modifying the MAX 4518 so that it is driven by the simple application of a power signal only requires jumpers from pin 2 (EN) to pin 14 (V+), and a second jumper across pin 4 (NO1) and pin 15 (GND). Thus configured, a single power supply voltage (here from the battery and/or from an external peripheral as a power source) will trigger all four of this analog muxes' channels. The 4518 will operate with up to a 15 VDC maximum input. This voltage is within the range of some battery pack output voltages. For higher voltages, power FETs are used. The MAX 4518 can be over-voltage protected with external blocking diodes (consult the MAXIM data sheet #19-1070). An upstream voltage regulator, preferably one with a wide range of input voltages, can be used with the MAX 4518.

Embedded in a Battery Pack or Peripheral

A multiplicity of connector elements can be integrated into an individual embodiment of the present interface apparatus, such as insulators, insulator rings, jumpered plugs, spring contacts, segmented contacts, etc., for configuring specific implementations and applications. The interface apparatus provides an effective upgrade to a host device and its associated battery pack to operate with a multiplicity of external peripherals. This interface adds functionality that was neither originally designed into a host device, nor its battery. The external peripherals may, or may not, have been originally designed by the host-device vendor specifically for a particular host device. These peripherals typically include an external power supply, battery charger, and a battery monitoring device. These may be separate single-function peripherals, or all three functions may be integrated into one attachable unit, with each sub-system capable of functioning autonomously. One of the primary objectives of the present invention is to provide users with configurable peripherals that automatically configure when connected to a wide range of unknown host devices.

FIG. 1A illustrates a plug 101A that is configured with a four-conductor cable 145. A first pair of conductors 123A and B, for example, attached to an external power supply peripheral 152 which is configurable to deliver a controllable output voltage to a host device 168 (FIG. 1B). Rechargeable battery 166 is the original power source for the host device.

In order to determine the correct voltage to which to configure the output of the power supply, a second pair of conductors 125A and B (FIG. 1A) is used. This second pair of conductors is configured in plug 101A and its mating receptacle 101B (FIG. 1B), so that the output voltage of battery 166 is readable along these conductors. Conductors 125A and B serve as voltage "sense" lines that transfer a power signal from the battery to an attached battery monitoring peripheral 154. This peripheral "awakens" when battery power is received, then acquires the incoming battery signal at an A/D converter 158.

Once the battery voltage is acquired, a processor circuit 150 in FIG. 1A (or 170 in FIG. 1B) and program instructions 162 in FIG. 1A (or 170 in FIG. 1B) compute power supply 152's variable output to a voltage value within the now known range of battery 166's output. This voltage signal is then output from the power supply to the host device 168 (FIG. 1B) via the first pair of conductors 123A and B. This example of a four-conductor interface apparatus enables an external controllable power supply to deliver a correct battery-based voltage to a host device, while also temporarily disengaging the battery from the host device's original battery-to-host circuit.

Where practical, embedding the sensing function in a host device 168 (FIG. 1B) does have the benefit of potential access to an existing A/D converter 174, processor 172, and perhaps even already-resident resources for embedding sensing software 170. Even though the host device might have a suitable processor and other voltage-sensing hardware and software, it is usually impractical to modify an existing host device. The voltage sensing and processing circuit, in this modality of the invention, is embedded—typically, in an external peripheral such as the battery monitoring unit 154 (FIG. 1A), or the configurable power supply 152, itself. A host device's battery pack, especially if it is a removable module, is an acceptable location for an embedded A/D converter 174, processor 172, and resident program instructions 170. This is especially a valid approach with "smart" batteries, which often have onboard processors and A/D converters. Should a "smart" battery be the site for the embedded sensing circuit, then the signal transferred along conductors 125A and B is for acquiring digital data signals. Digital data acquisition usually requires at least a third conductor, so one of the available power conductors 123A or B is then used.

Further details of the sensing circuit are not discussed here, because such circuits are commonly known and readily available to those skilled in the art.

By incorporating an N-signal switch as a means of controlling signal flow direction 178 (FIG. 7) in a circuit that includes conductors 125A and B (FIG. 1A), the previously referenced battery-voltage sensing circuit is combined with suitable software 162 (or 170 in FIG. 1B) to configure an external battery charging peripheral 156 to deliver an appropriate charging signal to a battery 166 (FIG. 1B). This adds further flexibility to this interactive circuit.

The battery charger peripheral 156 replaces the external power supply 152 in FIG. 1A at conductors 123A and B. Or, the sense-line conductors 125A and B branch at an N-signal switch 178 (FIG. 7), so that in a first switch position the signal from the battery 166 (FIG. 1B) travels the along a first branch comprised of conductors 123A and B to the battery monitoring peripheral 154. Just as the battery monitoring peripheral configured the output of the power supply 152, it also configures the charging profile of the battery charger 156. The charger delivers its charging signals to battery 166 (FIG. 1B) along conductors 123A and B.

Once the switch is in its second position, conductors 125A and B (FIG. 1A), as the second branch in the circuit, are available to the power supply 152 for delivering power to host device 168 (FIG. 1B). This configuration with a voltage-sensing circuit shared by both an external power supply 152 and a battery charger 156, enables sequential powering of a host device 168 and also recharging a battery 166.

Battery Monitor

Battery monitor 154 (FIG. 1A) is characterized as a device (or circuit within another device) that performs an information-acquisition function, namely acquiring voltage readings from a battery 166 (FIG. 1B). An A/D converter 158 (or 174) and a simple processor are the key elements required for this peripheral to function. The processor has an I/O which interfaces with a configurable power supply 152. A battery monitor 154 uses this I/O to communicate battery 166's voltage (read both without a load, then with a resistance in the line) to configurable power supply 152.

A Hall-effect device, or other methods of reading current known to those skilled in the art, can be used to acquire battery 166's current-delivery parameters, but these may not be necessary to the proper operation of the external power source.

Battery monitor 154 (FIG. 1A) uses both a load and no-load sampling of battery 166's output voltage to ascertain whether the battery is in a relative state of full-charge, or almost completely discharged. Should battery 166 be fully charged, its no-load output voltage will be substantially higher than its manufactured "design" output voltage. For example, a battery pack manufactured as "12 VDC" may read nearly 14-volts output under a no-load condition, even though it has less than 40% remaining capacity, but that output voltage may drop to less than 10.5-volts when tested under load A fully charged battery will not likely read less than 12-volts output when sampled under the same load. Since battery output may cover a range of voltages, depending on the load vs. no-load sampling results, program instruction in battery monitor 154 (alternatively 170 at battery 166 or host 168) uses a look-up table and an algorithm to determine what the manufacturer's "design" voltage is for battery 166.

Software attempts to accurately define an optimized operating input voltage for host device 168 in FIGS. 1B. Depending on its battery input-voltage design parameters, host device 168 can have a Vmin operating voltage well below the 12-volt rating of its battery 166. If the designer of the host device was striving for maximum battery-operating time, the Vmin battery voltage may be set low, to use every last coulomb of battery 166 capacity. With a Ni-Cad battery, this Vmin voltage cut off can be set as low as approximately 8 VDC. The spread between a battery 166's no-load and load voltage test results is a reasonable indicator of the remaining fuel reserves in the battery. If both Vmin and Vmax are depressed, then it's highly probable that the battery is near exhaustion.

Another indicator is how long it takes for a battery 166 to recover from a load test. All commonly used battery chemistries exhibit an accelerated voltage drop-off curve near the lower limits of their capacity, although the slope or rate of voltage drop may vary. So, reading under-load samples over time, or for a sustained amount of continuous time, are also somewhat valid probative procedures for evaluating the remaining capacity in the battery pack. Establishing a reasonable basis of remaining capacity is important to the operation of the interface apparatus, since the battery is expected to be relied on as a source of backup power.

Of course, if battery 166 (FIG. 1B) is a smart battery, and if there are data lines available at the connector assembly, battery monitor 154 simply polls the battery's data registers for information about its "design" voltage and fuel gauge reading. However, even smart battery technology, with its sophisticated fuel gauges, is not very accurate when it comes to determining the amount of energy reserves remaining in a battery. Error rates are sometimes 10–20%. Knowing this, host device manufacturers tend to allow an adequate margin of capacity in a battery at the prescribed Vmin battery shut-down voltage.

The relevance of knowing the approximate capacity reserves of a battery 166 (FIG. 1B) is related to connector interface 101F. If the battery is about to reach a state of near depletion, then battery monitor 154 is limited in the acquisition functions it can perform. For example, continued voltage sampling under load will produce variable results.

Should there be a lack of readable battery voltage at battery monitor 154, the operation of battery monitor 154 is to shut down power supply 152. In the situation where a battery 166 is incapable of sustaining a minimum voltage under load, battery monitor 154 delivers a shut-down command to power supply 152.

The processor 160 in FIG. 1A (or 172 of host 168 in FIG. 1B) that controls the configurable power supply operates on information about the battery. Specifically, based on acquired battery voltage information, the proper calculated input voltage of the host device is sent to power supply as a Vref value. Being a controllable switching power supply, it can output whatever Vref voltage is required. Power supply 311 is also capable of matching Vref as a function of its voltage-sense feedback loop (not shown). Specific information about the operation and characteristics of such a power supply is available in my U.S. Pat. No. 6,459,175, "Universal Power Supply" (1 Oct. 2002).

Battery Charger

A battery charging module 156 (FIG. 1A) is also available either as a stand-alone unit, or integrated into an external peripheral 150. The role of battery monitor 154 in conjunction with a battery charger, is similar to that already described for a battery monitor and a power supply 152. The battery monitor gathers data about a battery 166 (FIG. 1B). Once the presence of a battery 166—and the appropriate user-selected plug configuration for charger connectivity—are verified, battery monitor 154 determines the appropriate charge type and charger peripheral output configuration. Charge type is based on battery chemistry. See my U.S. Pat. No. 6,459,175, "Universal Power Supply," (1 October 2002) for information on charging based on battery chemistry.

Other tests are performed by battery monitor 154 to verify not only the type of battery, but the condition of the battery to accept a charge. This procedure may include a sophisticated impedance test, and perhaps even some cell balancing for Li-Ion batteries. These operations are essential because Ni-Cad charge characteristics, voltages and charge rates vary considerably from the method used to charge Li-Ion cells. Information about impedance testing is available from Cadex Electronics Inc. (Burnaby, BC, Canada).

It is possible to have both a battery charger 156 (FIG. 1A) and a configurable power supply 152 integrated in a multipurpose external assembly. In such a modality, battery 166 (FIG. 1B) can be charged simultaneously with power delivery to host device 168 if the interface apparatus is so configured. This embodiment reflects the same functions normally available to a battery 166 and its host device 168 when a plug 10A is removed. In other words, when the primary circuit between host device 168 and battery 166, as they were configured when manufactured, is re-established.

With battery information acquisition capabilities provided by a battery monitor 154 (FIG. 1A), a battery 166's (FIG. 1B) power parameters are acquired. The configuration of an interface apparatus 101F makes it possible to confirm that a battery 166 is present and available. Furthermore, the battery is also known to not be receiving a charge, because the connector configuration redirects the battery-to-host device circuit to engage the battery terminals to now be connected to external monitoring device 154, and not to an external charger 156. As long as battery monitoring device 154 is occupying battery 166, there can be no battery charging activity. By constantly polling the battery, the battery monitor device keeps track of battery 166's non-charging state.

Further, the connector apparatus is configured to create an electromechanical redirection of battery 166's circuit. There is no path for host device 168's internal charger circuit (not shown) to access its battery 166 and switches, while the plug 101A is inserted. (See discussions in the section "Cables and Muxes" about using diodes in circuits to enable a battery to deliver power to its associated host device even while a connector assembly is in use.

Having confirmed that battery pack 166 (FIG. 1B) is in a non-chargeable state, external power supply 152 (FIG. 1A) safely applies power to host device 168. Battery monitor 154 has communicated its acquired battery-power parameters to configurable power supply 152, so that the power supply can adjust its variable output signal based on the now-known output of battery 166. Since the battery is associated with and power-matched to its host device, a correct input voltage to the host device is assured by basing the output of external power supply 152 on the acquired power parameters of its battery. Battery monitoring device 154 has a processor 160 for configuring the controllable power output of a power supply 152, or the power supply itself may have the requisite processor, software, and even and A/D converter, thus operating as a self-contained data acquisition and power delivery peripheral Referencing my U.S. Pat. No. 6,459,175, "Universal Power Supply" (1 Oct. 2002) and my U.S. Pat. No. 6,634, 896, "Method and Apparatus for Transferring Electrical Signals Among Electrical Devices" (21 Oct. 2003), an external processor-enabled peripheral is capable of determining whether or not the interface apparatus configuration is appropriate for performing the operations of the attached peripherals. For example, if a combined power supply 152 (FIG. 1A) and a battery charger 156 are attached, the program instructions 162 of processor 160 and an A/D converter 158 use basic voltage and current sensing methodologies to verify that the anticipated circuits at the connector assembly 101F. are correctly configured. If an incorrect connector configuration is detected, neither the charger nor power supply will operate. If data lines are available, they are to pre-confirm the proper configuration, functioning, and operation of the connector apparatus.

Interrupted Data Lines and "Virtual" Data Lines

To disable battery charging, for example, any of the connectors shown (but not limited to those shown or equivalents) can effectively interrupt and reroute a data line. In a smart battery circuit, for example, rerouting a Clock (C), or Data (D) line will disrupt the circuit of a host device's charging circuit, battery selector, or keyboard controller—the disruption of any one of which is sufficient to prevent battery charging. A battery cannot effectively communicate its request to be charged if Clock or Data lines are not available. The data lines communicate in conjunction with the negative (–) polarity power signal in the SMBus Smart Battery Bus topology, so intervening a connector assembly of the invention on a powerline will have an impact on battery data communications.

But data transfer is not always limited to the use of cables and connectors. Wireless data is available in the form of radio frequency (RF) or infrared (Ir). This is relevant, in this example, to the elimination of conductors between an external third device, such as a battery monitor (or a battery monitor coupled to an external power supply). A smart battery data line can be physically interrupted and rerouted using the interface apparatus herein.

Most smart battery data communications require three or four conductors. Smart battery-to-host connector I/O ports typically have five contacts. To disrupt all five lines with a connector assembly 101F in FIGS. 1A and B such as that shown requires 10 conductors, with five conductors from a battery pack to an external device, and an additional five conductors from the external device to a host device. While adding two more contacts to plug 101A isn't impractical, it does create a substantially longer barrel assembly 103, as well as a more complex receptacle. The cumbersome cables that would result from routing 10 mixed-signal lines between external devices are not desirable.

In some battery and host data communications implementations, data continuity to a host device may have to be maintained, so that the host can handshake with a compliant battery (or equivalent) present. Without data continuity, the host device may refuse to turn ON, or it may lose track of its battery's "fuel gauge" readings. A wireless link can be established so that, even though the physical data circuit between a battery and its associated host device has been disrupted temporarily, a substitute data telemetry link can be used.

Alternative Electrical Paths

Alternative data paths can be created. One implementation of an alternative bi-directional data path has a multi-contact connector integrated into a small external module (a PC Card or dongle, for example), through which data lines are routed. The powerlines pass through the module, as well. The purpose of this module is to acquire data from a smart battery over standard conductors, but to not have to reroute those conductors to either a host device, or an external device, such as a power supply. The module performs data acquisition functions (especially easy if a National Instrument (Austin, Tex.) DAQ card, or equivalent, is used). Another alternative is to use a dongle configured like a Micro Computer Control (Hopewell, N.J.) SMBus monitor, that converts SMBus smart battery data to $I^2C$, or RS-232.

A number of infrared wireless dongles use a standard RS-232 interface for serial port communications, so those skilled in the art of wireless communications should have no difficulty in creating such a wireless data link.

Computer-readable data is then output to a radio transmitter, or to an infrared port. A comparably-equipped external peripheral, such as a charger or power supply, shares data with the wireless module. Software filters the data stream coming from a host device and/or a smart battery, looking for data relevant to battery charging. It may see requests from the smart battery, for example, to be charged. An external module would, in that situation, send a wireless signal back to the module, with a message for the smart battery advising it that the charger is not available. That "faux" information from the external peripheral is then routed internally in the host device through the connector I/O port that couples the host to its battery, into the battery's data circuit.

Malfunctions, such as spurious data on the smart battery bus that is misunderstood as a request to battery charge, are handled by having an external power supply 152 (FIG. 1A) (which is attached at the battery connectors in the host device, and not at the host device's power input jack), send "faux" data to a module previously described, which is routed to a host device through a connector assembly 101F. Viewed in one way, an external power supply's data intervention into a battery-to-host interface is one of emulating a battery when communicating to a host, and emulating a host when communicating to a battery. The task is, in this example, to prevent battery charging, so one approach is to send appropriate misinformation to a host system, that emulates a malfunctioning battery. Data sent to a battery emulates host messages which indicate that charging functions are not available.

In context of SMBus-based smart batteries, the host receives "aux" information from an external power source that the temperature level in a battery is exceeds a pre-set alarm level, for example. That will disable the host device's internal charger. A battery can receive alarm or alert states, which indicate a "no-charge-available" condition in the host device.

Another hypothetical scenario that could potentially cause an inappropriate battery charger activation in a host device might be that a plug 101A (FIG. 1A) could be inserted during an ongoing charging activity between a host 168 (FIG. 1B) and its battery 166. This is another highly remote situation, since the insertion of a plug 101A will disrupt all of the power and data lines. It would take an inordinate malfunction for a host device's smart battery charging circuit to keep functioning after any one of the four power/data lines 123A, 123B, 125A, and 125B was disrupted and for a charger to still be outputting a power signal after all four lines had been disrupted would be a significant improbability.

The issue of a host device turning on its internal charging circuit while an external peripheral is using those same battery lines to input power to a host device is moot. The probability of this happening is very remote, for two reasons. First, the host device is not drawing power from its AC/DC power-conversion adapter attached to the power input jack but, instead, the host device is drawing power from what it perceives is a battery but is actually an external power supply emulating that battery. There is no acknowledged power source connected to the host device that indicates available power to charge a battery, i.e., there is no AC/DC adapter or wall adapter connected to the power input jack of the host device. This makes any possibility of a host device being able to charge a battery essentially zero. Second, there is no request for a charge activity from a battery because this battery is temporarily disengaged by the connector assembly 101F (FIG. 1A) disrupting the previous host-to-battery conductors, so a host's charging circuit has no valid reason to turn on the charging circuit. (Many of the alternative approaches discussed here are further detailed in my U.S. Pat. No. 6,459,175, "Universal Power Supply," 1 Oct. 2002, and U.S. Pat. No. 6,634,896, "Method and Apparatus for Transferring Electrical Signals Among Electrical Devices," 21 Oct. 2003).

As previously discussed, in situations where the number of data lines is excessive enough to make wired communications to and from an external device impractical, wireless data communication links serve as alternatives multi-conductor data lines. The role of a connector assembly is the same . . . to create new data (and perhaps power) paths that are available at an external device.

SUMMARY AND SCOPE

The benefits of an interface apparatus creates different electrical paths when a plug is inserted or replaced include (but are not limited to) the following non-limiting examples:

1) Diminish the need to charge a battery pack when an external power source is available. By not charging a battery every time a host device is connected to an external source of power, the life expectancy of the battery is increased. Since most rechargeable battery-powered electronic devices automatically charge their batteries when external power is connected, the use of a connector that disables the battery charge function increases the useful life of the battery, thus reducing total operating cost.

2) Some locations may not find battery charging practical. Battery charging can consume 20–40% of the entire load schedule of a host device's power requirements. If a car's battery is low, operating a host device such as a laptop that is powered from the dashboard outlet could result in a stranded motorist.

3) Some transportation locations may not be suitable for battery charging. There is some risk in charging batteries, especially high-density Lithium-Ion batteries. An airline or cruise ship operator, for example, may wish to limit the risk of an onboard battery-related fire or explosion. A simple and cost effective method is to use battery packs and power cords that the subject interface apparatus which disables the charge function, while still allowing an external power supply to power the host device.

4) Extended-run-time external battery packs can be used to supplement a host-device's associated battery. These extra-high-capacity battery packs connect to a host device's existing power input jack. So configured, the external battery pack is dedicating some of its stored energy to charging the host device's battery. This occurs because host systems are designed to charge the associated battery whenever external power is available at the power input jack.

As a power source, a host device usually does not distinguish an external battery from an AC/DC wall adapter, for example, so the extended-run-time battery loses its effectiveness by having to relinquish some amount of its stored energy to charging the host's battery. By using a connector as defined herein, the external battery pack can be routed through the host device's existing battery pack and, by doing so, the charging circuits within the host device are temporarily disabled while the external battery source is in use. This enhances the run-time of the external battery pack, and also eliminates inefficient energy transfers between the two batteries.

These non-limiting examples of applications for connector assemblies such as those described in this document evidence several real-world uses.

Basic Design Parameters

Some of the design parameters achieved by the connector assemblies discussed herein include:

1) Small package size, especially for the receptacle, since available space within battery packs is limited.

2) Straightforward way to integrate a receptacle into an existing battery pack, or to install the receptacle in a new battery pack design in a way that doesn't require an inordinate amount of extra tooling or assembly.

3) Inexpensive

4) Simplicity of use

Ramifications

A number of advantages of the connector assembly of the present invention become evident:

(a). A simple, low-cost connector can be used to electrically separate two devices, or a host device and its power system.

(b). By isolating the battery source, or a peripheral, from the original host device, new circuits are created that allow external power sources, battery chargers, and other attachable peripherals to perform more safely because the battery voltage can be verified before that external power is applied to a host device.

(c). Because the plug has more than one configuration, additional specialty functions or operations can be performed.

(d). As a replaceable element, a plug 101E in FIG. 4 can be interchangeable at the end of a power or data cord, to afford access control to equipment or electronic devices.

(e). With very small form factors, the receptacle can be embedded inside a battery pack, to make it a self-contained unit that has a special power or data interface to external power or charging devices, or monitoring equipment. This can be accomplished without having to rewire or otherwise modify the host device. By replacing the existing battery pack with one configured with the receptacle, the functionality of both the battery and host device is enhanced, without permanent reconfigurations to either the battery pack or host device.

(f). The receptacle can be used as a replacement for an existing input power jack with minimal modifications or rewiring.

(g). Problems in changing both plugs and receptacles on electronic devices that have incompatible external adapter output voltages are no longer necessary. Instead, the receptacle is simply wired in a different configuration, and a new plug is used to differentiate the two incompatible external adapters. Any fear of possible mismatched voltages between external power adapters and host devices is eliminated.

(h). In certain modalities of the connector that use a "jumpered" terminator plug 167 (FIG. 8) to reinstate a circuit, the need for an ON/OFF power switch in conjunction with a power input jack is eliminated. The plug is configurable to turn the host device ON when inserted.

(i). The connector assembly has friction mechanisms 135, 137, 139A, and 139B (FIG. 3) that secures the plug to the receptacle, an important feature for devices like laptops that are often moved around in industrial or service applications.

(j). In certain environments, host devices that automatically charge their batteries when external power is applied can be easily modified by inserting a battery pack that has the receptacle installed. Thus configured, the host device is rendered compliant in situations where battery charging is not allowed.

(k). Monitoring battery charging can be done by an external device attached to the connector.

(l). Simultaneous battery monitoring and power delivery from an external device can be done without modifying the internal circuitry of the host device.

(m). By installing an N-signal switch that alters electrical circuits in response to applied power signals, and locating that switch in either the plug or receptacle of the connector apparatus, battery monitoring and power delivery can occur with a two-conductor cable that shares more than two contacts in the connector.

SCOPE OF THE INVENTION

Thus, the reader will see that the interface apparatus of the invention provides a convenient, low-cost, and when the receptacle is embedded in an a battery enclosure, inconspicuous and easily upgradeable connector assembly that not only provides safe power delivery by disabling battery charging, but enhances the overall functionality of any existing (or future) electronic and electrical goods by providing an interface to which a multiplicity of peripherals can be attached.

Although the description above contains many specificities, these should not be construed as limiting the scope of the invention, but as merely providing illustrations of some of the presently preferred embodiments of this invention. Many other variations are possible. For example, a receptacle 101B in FIG. 3 can be configured so that spring contacts 137, 139A and 139B engage adjacent conductive surfaces. When a plug is removed, contact 137 electrically engages conductive surface 133B with conductive surface 130, thereby closing a circuit. The receptacle is reconfigurable to even have inward spring contact 139B oppose and self-close with outward spring contact 137. By the placement and movement of the spring contacts, all circuits of the interface apparatus would automatically be reinstated, thus eliminating the need for a "jumpered" terminator plug 167 (FIG. 8). Thus, the scope of the invention should be determined by the appended claims and their legal equivalents, rather than by the embodiments illustrated herein Thus, an interface apparatus for transferring electrical signals, including power and input/output data among multiple electrical devices and their components, is described in conjunction with one or more specific embodiments. The invention is defined by the claims and their full scope of equivalents.

I claim:

1. A connector assembly for transfer of electrical signals among one or more devices, said connector assembly comprising:

a connector plug comprising a conductive center pin having one or more conductive segments, said center pin surrounded by a conductive sleeve having an interior surface and an exterior surface, at least one of said surfaces having one or more conductive segments; and a connector receptacle for receiving said connector plug comprising:

a first conductive sleeve having an interior surface comprising one or more conductive segments for mating with said one or more conductive segments of said exterior surface of said conductive sleeve of said connector plug;

a second conductive sleeve having an exterior surface comprising one or more conductive segments for mating with said one or more conductive segments of said interior surface of said conductive sleeve of said connector plug; and a third conductive sleeve having an interior surface comprising of one or more conductive segments for receiving said one or more conductive segments of said center pin of said connector plug;

wherein mating said one or more conductive segments of said connector plug and said connector receptacle causes one or more electrical signals from one or more electric devices coupled to said connector plug to be transferred among one or more electric devices coupled to said connector receptacle.

2. A method of transferring one or more electrical signals among one or more devices using the connector assembly of claim, 1 comprising:

transferring one or more electrical signals from a source along conductive wiring to at least one of said one or more conductive segments of said connector plug;

mating said connector receptacle to said connector plug such that said receptacle's one or more conductive segments of the interior surface of said first conductive sleeve are coupled to said plug's one or more conductive segments of said exterior surface of said conductive sleeve; said receptacle's one or more conductive segments of the exterior surface of said second conductive sleeve are coupled to said plug's one or more conductive segments of said interior surface of said conductive sleeve; and said receptacle's one or more conductive segments of the interior surface of said third conductive sleeve receive said pin's one or more conductive segments of said center pin;

transferring one or more electrical signals induced in said one or more conductive segments in said connector receptacle to one or more devices attached thereto.

* * * * *